US010612817B2

(12) United States Patent
Knoeppel et al.

(10) Patent No.: US 10,612,817 B2
(45) Date of Patent: Apr. 7, 2020

(54) SYSTEM AND METHOD OF CONTROLLING A WATER HEATER HAVING A POWERED ANODE

(71) Applicant: A. O. SMITH CORPORATION, Milwaukee, WI (US)

(72) Inventors: Ray Oliver Knoeppel, Hartland, WI (US); Michael William Schultz, Columbia, SC (US); Timothy Edward Rooney, Waukesha, WI (US); Thomas G. Van Sistine, Hartsville, SC (US)

(73) Assignee: A. O. SMITH CORPORATION, Milwaukee, WI (US)

( * ) Notice: Subject to any disclaimer, the term of this patent is extended or adjusted under 35 U.S.C. 154(b) by 330 days.

(21) Appl. No.: 15/807,118

(22) Filed: Nov. 8, 2017

(65) Prior Publication Data

US 2018/0128514 A1 May 10, 2018

Related U.S. Application Data

(60) Provisional application No. 62/419,207, filed on Nov. 8, 2016.

(51) Int. Cl.
*F24H 9/20* (2006.01)
*F24H 1/20* (2006.01)
(Continued)

(52) U.S. Cl.
CPC ..... *F24H 9/2035* (2013.01); *C23F 13/005* (2013.01); *C23F 13/04* (2013.01); *C23F 13/06* (2013.01); *F24H 1/205* (2013.01)

(58) Field of Classification Search
CPC ..... F24H 9/2035; F24H 1/205; C23F 13/005; C23F 13/04; C23F 13/06
See application file for complete search history.

(56) References Cited

U.S. PATENT DOCUMENTS 4,972,066 A 11/1990 Houle et al.
5,176,807 A 1/1993 Kumar
(Continued)

FOREIGN PATENT DOCUMENTS

EP 1426467 A1 6/2004
WO 2007010335 A2 1/2007
WO 2014060837 A1 4/2014

OTHER PUBLICATIONS

International Search Report and Written Opinion for Application No. PCT/US2017/060627 dated Jan. 22, 2018 (10 pages).
(Continued)

*Primary Examiner* — Steven S Anderson, II
(74) *Attorney, Agent, or Firm* — Michael Best & Friedrich LLP

(57) ABSTRACT

A gas-fired appliance includes a tank configured to store a fluid to be heated, a powered anode extending into the tank and configured to generate an electric anode current, and a combustion chamber including a burner configured to generate products of combustion. The appliance also includes an exhaust structure, a heat exchanger, and an electronic processor coupled to the powered anode. The products of combustion flow from the combustion chamber to the exhaust structure via the heat exchanger. The electronic processor is configured to determine a duty cycle of the burner, determine whether the duty cycle of the burner exceeds a predetermined threshold, increase a magnitude of a protection parameter of the powered anode from a first value to a second value when the duty cycle of the burner exceeds the predetermined threshold, and control the powered anode according to the second value of the protection parameter.

20 Claims, 17 Drawing Sheets

(51) Int. Cl.

| | |
|---|---|
| ***C23F 13/00*** | (2006.01) |
| ***C23F 13/04*** | (2006.01) |
| ***C23F 13/06*** | (2006.01) |

(56) References Cited

U.S. PATENT DOCUMENTS

| | | | | |
|---|---|---|---|---|
| 6,435,424 | B1 | 8/2002 | Pauley et al. | |
| 8,162,232 | B2 | 4/2012 | Knoeppel et al. | |
| 9,267,209 | B2 | 2/2016 | Knoeppel et al. | |
| 9,335,065 | B2 | 5/2016 | Farris et al. | |
| 2004/0139929 | A1 | 7/2004 | Nightlinger et al. | |
| 2006/0083491 | A1 | 4/2006 | Knoeppel et al. | |
| 2009/0056644 | A1* | 3/2009 | Phillips | F24H 9/0047 122/15.1 |
| 2009/0308332 | A1* | 12/2009 | Tanbour | F23C 7/02 122/14.2 |
| 2014/0334807 | A1 | 11/2014 | Farris | |
| 2019/0049146 | A1* | 2/2019 | Knoeppel | F24H 1/181 |

OTHER PUBLICATIONS

International Preliminary Report on Patentability for Application No. PCT/US2017/060627 dated May 23, 2019 (6 pages).

* cited by examiner

| | Standard Operation<br><br>Average Anode Current (mA) | Method 400 of FIG. 6<br><br>Average Anode Current (mA) | Method 450 of FIG. 8<br><br>Average Anode Current (mA) | Method 450 of FIG. 8 and Method 500 of FIG. 10<br><br>Average Anode Current (mA) |
|---|---|---|---|---|
| Overall | 86.8 | 92.6 | 99.7 | 104.3 |
| Heating | 87.8 | 114.2 | 147.3 | 147.3 |
| Heating + PrePurge / Post Purge | 87.1 | 106.8 | 131.6 | 147.2 |

FIG. 12

SYSTEM AND METHOD OF CONTROLLING A WATER HEATER HAVING A POWERED ANODE

RELATED APPLICATIONS

This application claims priority to U.S. Provisional Application No. 62/419,207 filed on Nov. 8, 2016, the entire contents of which are included by reference herein.

FIELD

Embodiments relate to water heaters.

SUMMARY

Gas-fired water heaters include heat exchangers that transfer the heat from the products of combustion to the water surrounding the heat exchanger. The temperature near the surface of the heat exchanger may sometimes be significantly higher than the temperature of other portions of the water tank. Such a temperature may make the surface of the heat exchanger more vulnerable to corrosion.

Additionally, commercial gas-fired water heaters typically operate at higher duty cycles compared to residential water heaters. Such high duty cycles also increase the average temperature near the surface of the heat exchanger because the heat exchanger is activated for longer periods of time. The increased average temperature makes the surface of the heat exchanger in commercial gas-fired water heaters more vulnerable to corrosion. For example, the duty cycle of commercial water heaters may be between 15%-40% higher than the duty cycle of a similar residential water heater. Such increased duty cycles may significantly increase the average temperatures on the heat exchanger in comparison to other surfaces of the water tank. For example, in one study, it was found that the temperature of the surface of the heat exchanger was approximately 40° F. higher than the other surfaces of the water tank when the burner is activated. In the same study, it was found that the surface of the heat exchanger has a corrosion rate that is approximately 20% higher when heat is applied (e.g., the burner is powered) compared to when no heat is applied (e.g., the burner is off).

In one embodiment, the application may provide an exemplary water heater including a water tank for water to be stored, a powered anode extending into the tank and configured to generate an electrical anode current, a combustion chamber, and an exhaust structure. The water heater also includes a flue in fluid communication between the combustion chamber and the exhaust structure, and a controller. The combustion chamber includes a burner operable to burn a mixture of air and fuel generating products of combustion, the products of combustion flowing through the flue to the exhaust structure to heat the water in the tank. The controller coupled to the powered anode and operable to determine a duty cycle of the burner, determine whether the duty cycle of the burner exceeds a threshold, increase a protection parameter of the powered anode based on a duty cycle of the burner, and operate the powered anode at the increased protection parameter.

In another embodiment, the application provides an exemplary method of operating a gas water heater. The method includes determining, by the electronic processor, a duty cycle of a burner of the water heater, and determining, by the electronic processor, whether the duty cycle of the burner exceeds a high threshold. Increasing, by the electronic processor, a protection parameter associated with a powered anode extending into a tank of the water heater in response to the duty cycle of the burner being above the high threshold. The method further comprising operating the powered anode according to the increased protection parameter.

Other aspects of the application will become apparent by consideration of the detailed description and accompanying drawings.

BRIEF DESCRIPTION OF THE DRAWINGS

FIG. 12 is a chart comparing the different methods discussed with respect to FIGS. 6, 8, and 10.

DETAILED DESCRIPTION

Before any embodiments of the application are explained in detail, it is to be understood that the application is not limited in its application to the details of construction and the arrangement of components set forth in the following description or illustrated in the following drawing. The application is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
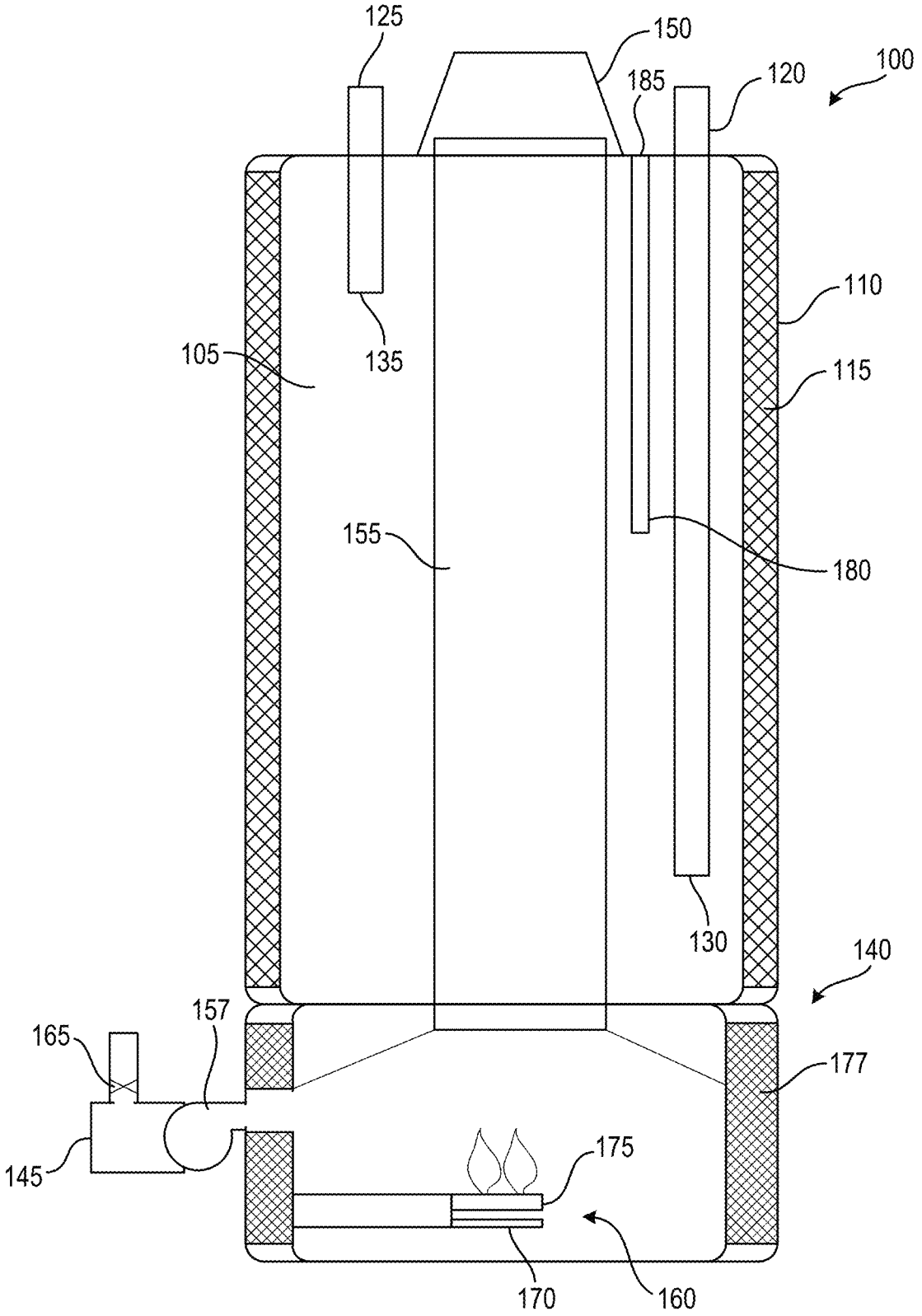
FIG. 1 is a schematic diagram of a gas-fired water heater according to some embodiments of the application.

FIG. 1 is a schematic diagram of an appliance 100 according to some embodiments of the application. In the illustrated embodiment, appliance 100 is a gas-fired water heater 100, however, in other embodiments, the appliance 100 may be any appliance operable to heat a medium, for example but not limited to, an electric water heater, a gas-fired furnace, a gas-fired boiler, and an electric furnace. In the illustrated embodiment, the water heater 100 includes an enclosed water tank 105, a shell 110 surrounding the water tank 105, and foam insulation 115 filling an annular space between the water tank 105 and the shell 110. The water tank 105 may be made of ferrous metal and lined internally with a glass-like porcelain enamel to protect the metal from corrosion. In other embodiments, the water tank 105 may be made of other materials, such as plastic.

A water inlet line 120 and a water outlet line 125 are in fluid communication with the water tank 105. In the illustrated embodiment, the water inlet line 120 and the water outlet line 125 are in fluid communication with the water tank 105 at a top portion of the water heater 100. In other embodiments, the water inlet line 120 may be at a bottom portion of the water heater 100, while the water outlet line 125 may be at the top portion of the water heater 100. In yet another embodiment, the water inlet line 120 may be the top portion of the water heater 100, while the water outlet line 125 may be at the bottom portion of the water heater 100. The inlet line 120 includes an inlet opening 130 for adding cold water to the water tank 105, and the outlet line 125 includes an outlet opening 135 for withdrawing hot water from the water tank 105 for delivery to a user.

The water heater 100 also includes a combustion chamber assembly 140, an air intake assembly 145, and an exhaust structure 150. In the illustrated embodiment, the combustion chamber assembly 140 is positioned under the water tank 105 and supports the water tank 105. In other embodiments, the combustion chamber assembly 140 is positioned above the water tank 105. The water heater 100 also includes a flue 155 in fluid communication with the combustion chamber assembly 140 and the exhaust structure 150. The air intake assembly 145 includes a blower 157, which draws ambient air and provides the air to the combustion chamber assembly 140.

The combustion chamber assembly 140 includes a burner 160, a gas valve 165, a flame sensor 170, and an igniter 175. The combustion chamber assembly 140 receives air from the air intake assembly 145. The igniter 175 is then powered to a predetermined temperature (or for a predetermined period of time). Once the igniter 175 reaches a temperature capable of initiating a flame, the gas valve 165 is opened. Gaseous fuel flowing through the gas valve is mixed with primary air from the air intake assembly 145. The blower 157 mixes the ambient air with the gaseous fuel to form a partially premixed combustible mixture, which is pushed toward the burner 160. This combustible mixture is ignited by the igniter 175, which causes the burner 160 to generate hot products of combustion. The flame sensor 170 is positioned proximate (for example, next to) to the igniter 175 and generates a signal indicative of whether a flame is present. The combustion chamber assembly 140 is surrounded by a high temperature insulation 177 to retain the heat from the hot products of combustion.

The hot products of combustion flow upward through the flue 155 toward the exhaust structure 150. As the products of combustion flow through the flue 155, heat is transferred from the products of combustion to the flue wall and to the water surrounding the flue 155. For this reason, the flue 155 is sometimes referred to as the heat exchanger of the water heater 100. In the illustrated embodiment, the hot products of combustion flow upward through the flue 155. In other embodiments, however, when the combustion chamber assembly 140 is positioned above the water tank 105, for example, the hot products of combustion flow downward through the flue 155. In such embodiments, the exhaust structure 150 may be positioned at a lower portion of the water heater 100. In yet other embodiments, the hot products of combustion may flow downward during a first portion of the flue 155 and may flow upward during a second portion of the flue 155. Although illustrated as being substantially straight, in other embodiments, the flue 155 may take other forms or shapes, for example but not limited to, a substantially helical shape.

The water heater 100 also includes a powered anode 180. In the illustrated embodiment, the powered anode 180 is threaded or otherwise secured into an anode spud 185 located at the top portion of the water heater 100. However, in other embodiments, the anode spud 185 may be located at the side of the shell 110, or at the bottom portion of the water heater 100. In operation, the powered anode 180 generates a current which reduces and/or eliminates the rate of corrosion of the tank 105. In some embodiments, the water heater 100 may include more than one anode or electrode. In some embodiments, for example, a reference electrode is positioned to measure a reference current, which is then used to control the powered anode 180. In other embodiments, multiple powered anodes 180 may be provided to increase protection delivered to the water tank 105. In the illustrated embodiment, the water heater 100 includes a single powered anode 180. If additional electrodes are included in the water heater 100, the control will mirror that of a single powered anode 180, and/or some of the electrodes are instead used for measuring reference parameters.

Figure 2:
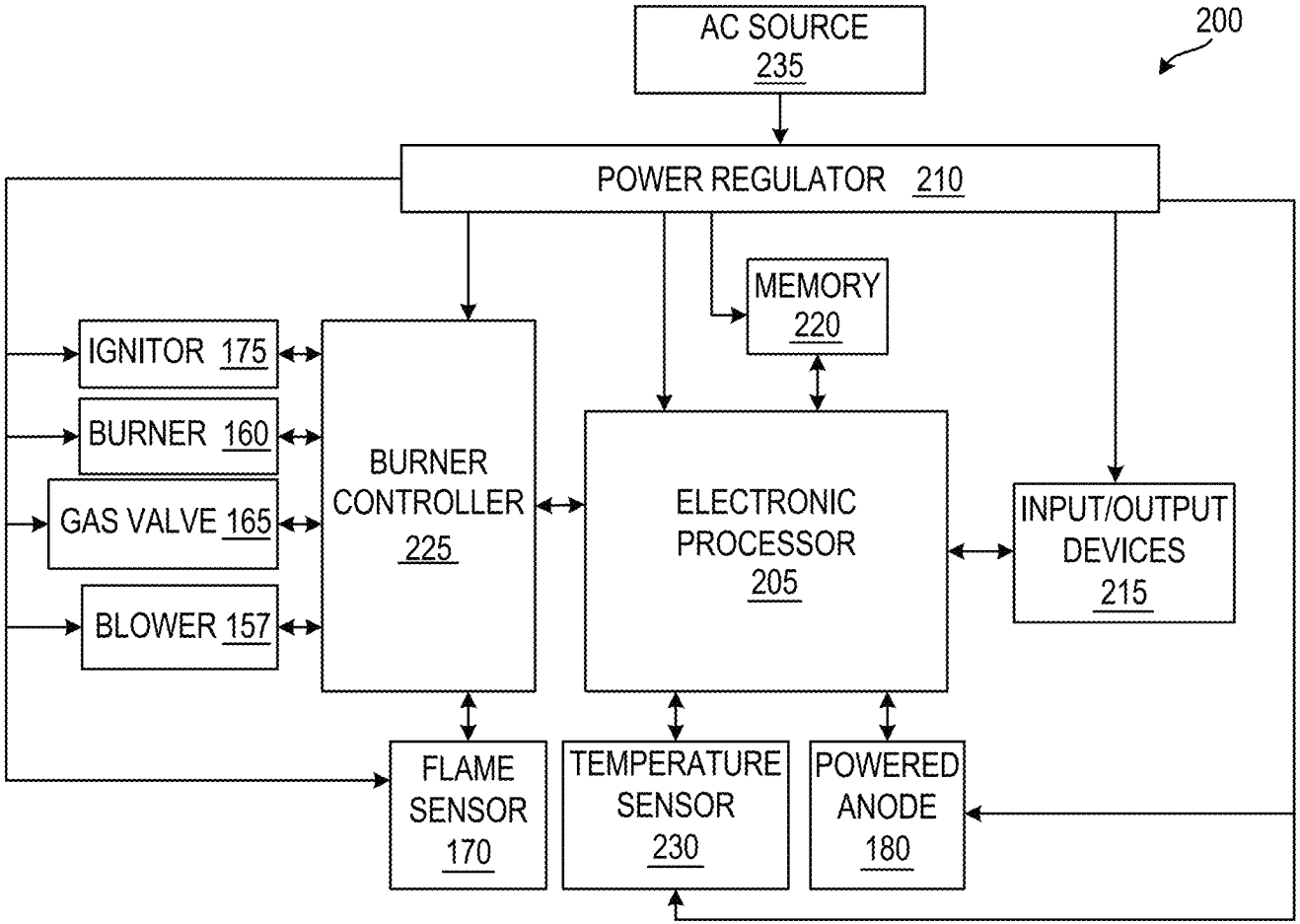
FIG. 2 is a step diagram of a control circuit for the gas-fired water heater of FIG. 1 according to some embodiments of the application.

The operation of the powered anode 180 and the burner 160 are controlled by a control circuit 200 (FIG. 2). FIG. 2 illustrates a block diagram of the control circuit 200 according to some embodiments of the application. The control circuit 200 includes an electronic processor 205, a power regulator 210, a set of input/output devices 215, a memory 220, a burner controller 225, a temperature sensor 230, and the powered anode 180. The control circuit 200 receives power from an alternating current (AC) power source 235. In one embodiment, the AC power source 235 provides 120 VAC at a frequency of approximately 50 Hz to approximately 60 Hz. In another embodiment, the AC power source 235 provides approximately 220 VAC at a frequency of approximately 50 Hz to approximately 60 Hz. The power regulator 210 receives the power from the AC power source 235 and converts the power from the AC power source 235 to a nominal voltage (for example, a DC voltage). The power regulator 210 provides the nominal voltage to the control circuit 200 (for example, the electronic processor 205, the input/output devices 215, and the like). In other embodiments, rather than an AC power source 235, the control circuit 200 may be configured to receive power from a DC power source.

The input/output devices 215 output information to the user regarding operation of the water heater 100 and may also receive one or more inputs from the user. In some embodiments, the input/output devices 215 may include a user interface for the water heater 100. The input/output devices 215 may include a combination of digital and analog input or output devices required to achieve control and monitoring for the water heater 100. For example, the input/output devices 215 may include a touch screen, a speaker, buttons, and the like, to output information and/or receive user inputs regarding the operation of the water heater 100 (for example, a temperature set point at which water is to be delivered from the water tank 105). The electronic processor 205 controls the input/output devices 215 to output information to the user in the form of, for example, graphics, alarm sounds, and/or other known outputs. The input/output devices 215 are operably coupled to the electronic processor 205 to control temperature settings of the water heater 100. For example, using the input/output devices 215, a user may set one or more temperature set points for the water heater 100.

The input/output devices 215 may also be configured to display conditions or data associated with the water heater 100 in real-time or substantially real-time. For example, but not limited to, the input/output devices 215 may be configured to display characteristics of the burner 160 (for example, whether the burner is activated or malfunctioning), temperature of the water, and/or other conditions of the water heater 100. In some embodiments, the input/output devices 215 may also generate alarms regarding the operation of the water heater 100.

The input/output devices 215 may be mounted on the shell of the water heater 100, remotely from the water heater 100, in the same room (for example, on a wall), in another room in the building, or even outside of the building. The input/output devices 215 may provide an interface between the electronic processor 205 and a user interface that includes a 2-wire bus system, a 4-wire bus system, and/or a wireless signal.

The memory 220 stores one or more algorithms and/or programs used to control the blower 157, the burner 160, the powered anode 180, and/or other components of the water heater 100. The memory 220 may also store operational data of the water heater (for example, when the burner 160 has been activated, historical data, usage patterns, and the like) to help control the water heater 100.

The burner controller 225 is in electrical communication with the electronic processor 205 and the memory 220 to control the combustion components of the water heater 100. In particular, the burner controller 225 controls the blower 157, the burner 160, igniter 175, and the gas valve 165. For example, the burner controller 225 determines when the gas valve 165 is to be opened, the igniter 175 is to be powered, and the like. The burner controller 225 also receives output signals from the flame sensor 170. In some embodiments, the burner controller 225 also receives sensor signals from the temperature sensor 230 to determine when the burner 160 is to be activated. In some embodiments, the burner controller 225 includes a second electronic processor separate from the electronic processor 205 to independently control the blower 157, the burner 160, and the gas valve 165. In other embodiments, however, the electronic processor 205 executes control of the blower 157, the burner 160, and the gas valve 165 directly (for example, without the burner controller 225).

The electronic processor 205 is coupled to the power regulator 210, the input/output devices 215, the memory 220, the burner controller 225, the temperature sensor 230, and the powered anode 180. The electronic processor 205 receives an output signal from the temperature sensor 230 indicating the temperature of the water in the water tank 105. In some embodiments, the water heater 100 includes more than one temperature sensor 230 positioned in various portions of the water heater 100 to measure the temperature of the water at various locations. The electronic processor 205 accesses the memory 220 to retrieve information relevant to the operation of the water heater 100. For example, the electronic processor 205 may retrieve information regarding the usage patterns for the water heater 100, the previous activations of the burner 160, and the like. The electronic processor 205 uses the information retrieved from the memory 220 to control the powered anode 180. In some embodiments, the electronic processor 205 also outputs control signals to the burner controller 225 regarding the operation of the blower 157, the burner 160, and/or the gas valve 165. The burner controller 225 then executes the commands based on the received control signals.

The electronic processor 205 controls the powered anode 180 by controlling the anode current. The anode current may be controlled by changing the protection parameters of the powered anode 180, which include an applied voltage to the powered anode 180, a setpoint voltage (or target voltage), an applied current, a minimum current threshold, a maximum current threshold, among others. The effectiveness of the powered anode 180 is at least partially based on the values of each of the protection parameters. For example, if a higher degree of protection for the water tank 105 is desired at least one of the protection parameters is increased. On the other hand, if a lower degree of protection is desired at least one of the protection parameters is decreased. A lower degree of protection may be desired to reduce hydrogen sulfide levels in the water tank 105 such that an unpleasant odor is reduced.

The electronic processor 205 implements a control algorithm such that the powered anode 180 provides sufficient protection to the water heater 100. Typically, the protection parameters of the powered anode 180 are determined based on, for example, a water conductivity and/or a "natural potential" of the water heater 100. For example, in one embodiment, the electronic processor 205 may determine a level of water conductivity (e.g., low water conductivity, medium water conductivity, or high water conductivity) and apply different anode currents based on the determined level of water conductivity. In such embodiments, the electronic processor 205 applies higher anode currents with increasing levels of water conductivity.

In other embodiments, the electronic processor 205 applies a voltage to the powered anode 180 such that the powered anode voltage remains near a setpoint voltage (or target voltage). The setpoint voltage is based on a "natural potential" of the water tank 105 to properly account for the changing amount of exposed steel in the water tank 105. In some embodiments, the setpoint voltage is adjustable also based on the water conductivity such that the setpoint voltage considers not only the current amount of exposed steel in the water tank 105, but also the conductivity of the water. As discussed above, when the water conductivity is lower, the anode current decreases (for example, the voltage applied to the powered anode 180 also decreases). When the water conductivity is higher, the anode current increases (for example, the voltage applied to the powered anode 180 also increases). Notably, in some embodiments, the applied voltage and the setpoint voltage are negative quantities. This application may refer to the applied voltage and/or the setpoint voltage as increasing or decreasing. Please note that these increases and decreases refer specifically to the magnitude of the applied voltage and/or the setpoint voltage. In other words, increasing a setpoint voltage may include changing the setpoint voltage from −2.6V to −2.9V. Therefore, as discussed above, when the water conductivity is lower, the magnitude of the applied voltage decreases, and when the water conductivity is higher, the magnitude of the applied voltage increases.

The typical increase in anode current provided with the control algorithms described above may still not be sufficient to properly protect the surface of the heat exchanger (i.e., the flue 155), especially when the water heater 100 operates at high duty cycles. Commercial water heaters typically operate at higher duty cycles (e.g., when compared to their residential counterparts) and experience a majority of corrosion on the surface of the heat exchanger (i.e., the flue 155) due to the high temperatures of the water near the flue 155. Therefore, the electronic processor 205 controls the powered anode 180 implementing a control method that can properly protect the surface of the flue 155 of commercial water heaters (or other water heaters operating at high duty cycles).

Figure 3:
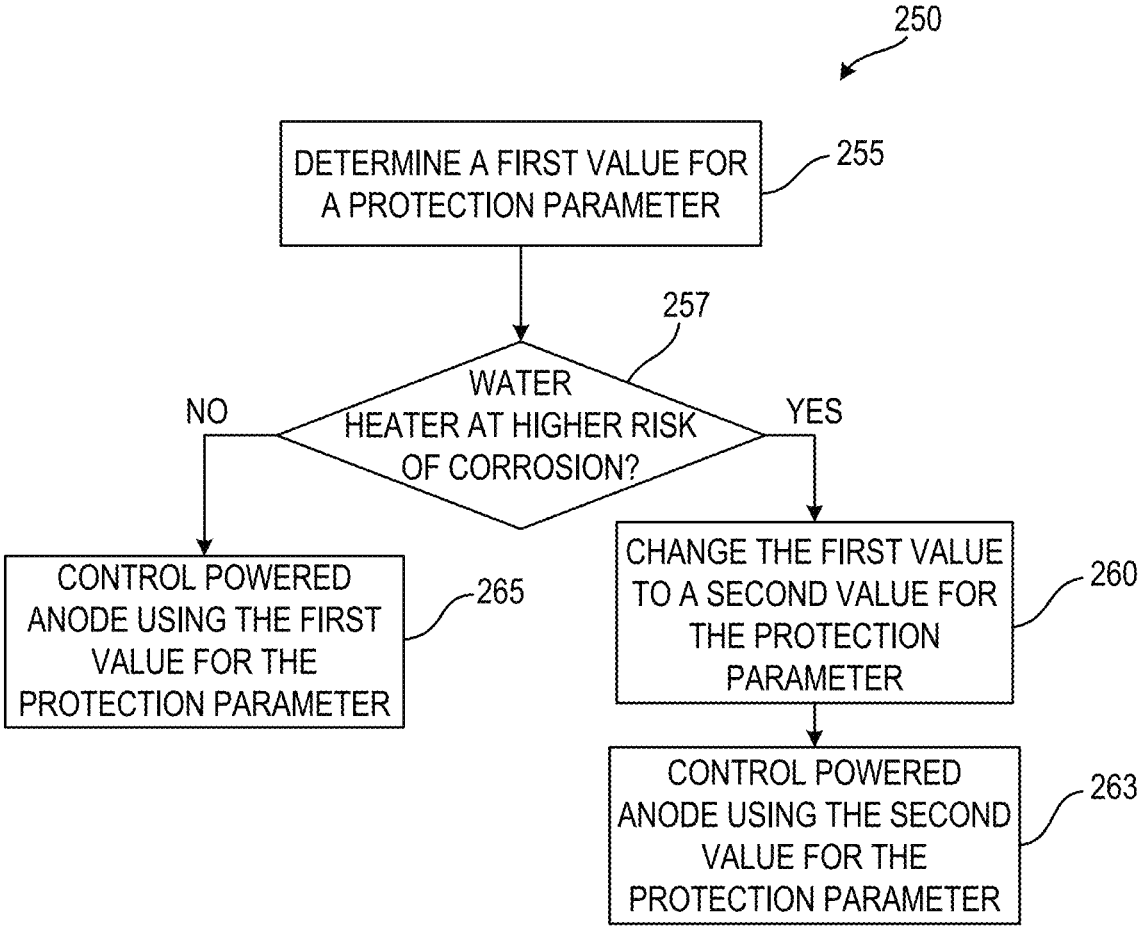
FIG. 3 is a flowchart illustrating a method of operating a powered anode of the gas-fired water heater of FIG. 1 according to some embodiments of the application.

FIG. 3 is a flowchart illustrating an improved method 250 of controlling the powered anode 180. In particular, the electronic processor 205 first determines a first value for a protection parameter of the powered anode 180 (step 255). In some embodiments, the electronic processor 205 uses one or more of the typical methods described above to determine the first value for the protection parameter. In other embodiments, the electronic processor 205 implements a different method to determine the first value for the protection parameter. Based on the method used to determine the first value for the protection parameter, the electronic processor 205 may also determine a first set of values for the protection parameters of the powered anode 180. The electronic processor 205 determines whether the water heater 100 is at a higher risk of corrosion (step 257). In one example, the electronic processor 205 may determine that the water heater 100 is at a higher risk of corrosion when the duty cycles for the water heater 100 exceed a predetermined threshold, and/or when the burner 160 is in operation. When the electronic processor 205 determines that the water heater 100 is at a higher risk of corrosion, the electronic processor 205 changes the value for the protection parameter to a second value (step 260). In particular, the second value is higher than the first value, so the electronic processor 205 increases the first value to the second value for the protection parameter. The electronic processor 205 then controls the powered anode 180 using the second value for the protection parameter (step 263). On the other hand, when the electronic processor 205 determines that the water heater 100 is not at an increased risk of corrosion, the electronic processor 205 controls the powered anode 180 based on the first value for the protection parameter (step 265).

Figure 4:
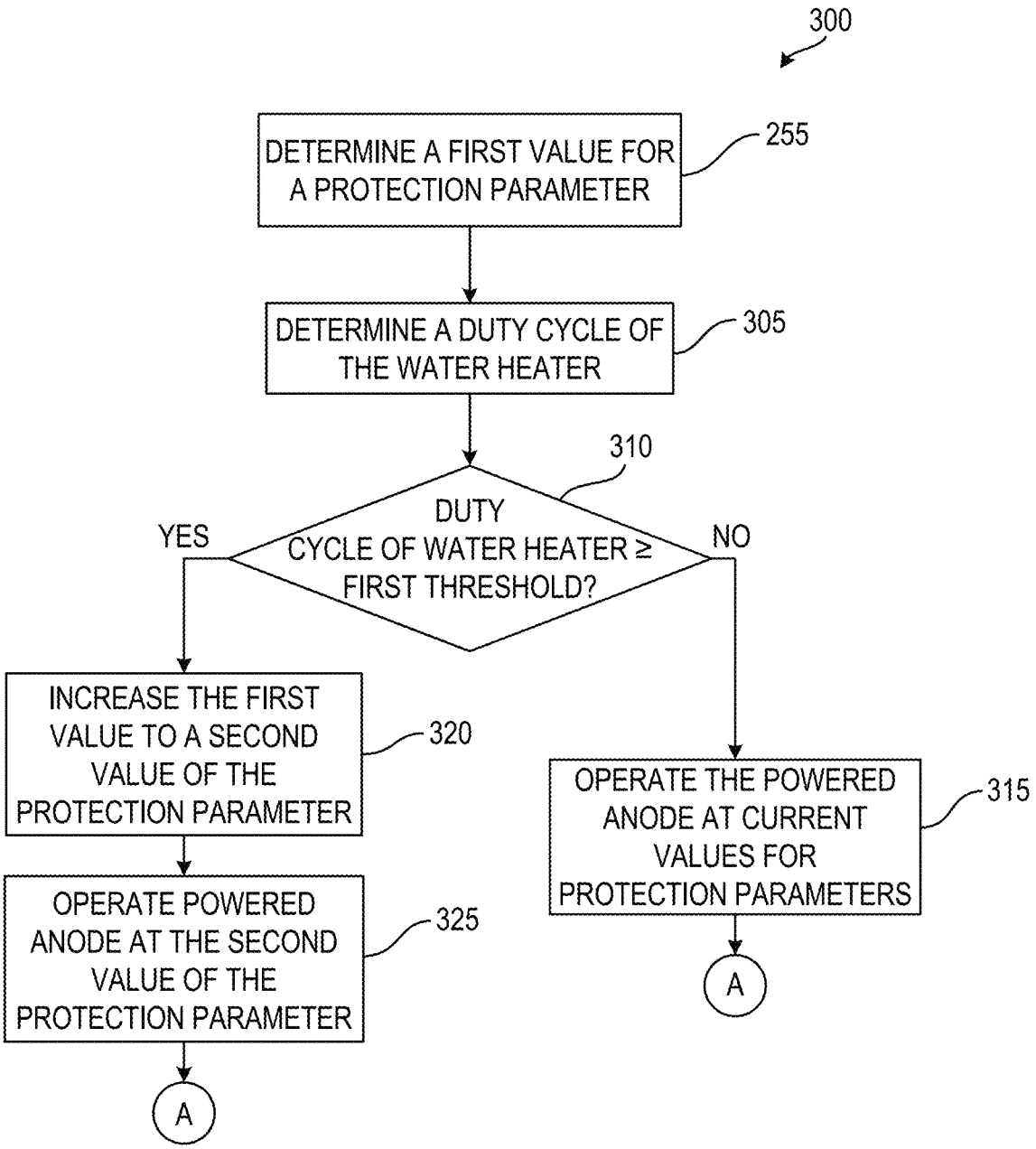
FIG. 4 is a flowchart illustrating a method of controlling a powered anode based on a duty cycle of the water heater of FIG. 1 according to some embodiments of the application.

FIG. 4 illustrates a particular methods 300 of changing the value for a protection parameter of the powered anode 180 as described with respect to step 260 of FIG. 3. Specifically, FIG. 4 is a flowchart illustrating a method 300 of controlling the powered anode 180 based on a duty cycle of the water heater 100. As mentioned above, the electronic processor 205 determines a first value for a protection parameter of the powered anode 180 (step 255 of FIG. 3). The first value may be based on normal operating conditions expected for the water heater 100 (for example, for water heaters operating at an average duty cycle, average temperature, and the like) and for specified water conductivities and/or "natural potentials" of the powered anode 180. The electronic processor 205 also determines a duty cycle of the water heater 100 (step 305). In some embodiments, the electronic processor 205 determines an overall duty cycle, which considers the duty cycle of the water heater 100 over the lifetime of the water heater 100. In other embodiments, the electronic processor 205 may determine a recent duty cycle, which is updated based on an update cycle. In other words, the recent duty cycle spans a predetermined period of time and is recalculated at the end of the update cycle. The length of the update cycle may be, for example, two months. Re-calculating the duty cycle based on the update cycle allows the electronic processor 205 to detect a short-term change in the duty cycle of the water heater 100. For example, a water heater 100 operating at a school experiences a high overall duty cycle since the burner 160 operates often during the school year. However, during the summer months, the duty cycle of the water heater 100 may significantly decrease. The sharp decrease in duty cycle during the summer months would be detected by the electronic processor 205 when utilizing the recent duty cycle measure. The electronic processor 205 could then alter operation of the water heater 100 and/or the powered anode 180 during the time of decreased duty cycles (for example, during the summer months).

The electronic processor 205 may access both the overall duty cycle and the recent duty cycle from the memory 220. The electronic processor 205 may update the calculation of the overall duty cycle on every activation of the burner 160, or may update the overall duty cycle by batches per a predetermined scheduled (for example, every week the new activation data is considered when calculating the overall duty cycle). As discussed above, the recent duty cycle is recalculated according to an update cycle.

The electronic processor 205 next determines whether the duty cycle of the water heater 100 exceeds a first threshold (step 310). The first threshold represents a duty cycle that affects the average temperature of the flue 155 due to the amount of time that the burner 160 is activated. In the illustrated embodiment, the first threshold may correspond to a duty cycle of 25%. When the duty cycle of the water heater 100 does not exceed the first threshold, the electronic processor 205 operates the powered anode at the first value of the protection parameter (step 315). On the other hand, when the duty cycle of the water heater 100 does exceeds the first threshold, the electronic processor 205 increases the first value to a second value of the protection parameter (for example, the applied voltage, the setpoint voltage, and/or the applied current) of the powered anode 180 (step 320). The electronic processor 205 then operates the powered anode 180 according to the second value of the protection parameter (step 325).

In the illustrated embodiment, the value for the protection parameter is increased by approximately 30% after the electronic processor 205 determines that the duty cycle of the water heater 100 exceeds the first threshold. However, no further increments of the value(s) for the protection parameters are performed based on the duty cycle of the water heater 100. In other embodiments, however, the protection parameter is increased based on a difference between the first threshold and the duty cycle of the water heater 100 (for example, the duty cycle of the burner 160). For example, the increase in the protection parameter of the powered anode 180 is approximately proportional to the duty cycle of the water heater 100. In other words, as the duty cycle of the water heater 100 increases, the protection parameter of the powered anode 180 increases proportionately. In other embodiments, the protection parameter is increased according to a difference between the duty cycle of the water heater 100 and a normalized duty cycle value. In some embodiments, the electronic processor 205 may determine a different set of values for the protection parameters based on the duty cycle of the water heater 100. For example, the electronic processor 205 may access a look-up table that indicates a range of duty cycles for the water heater 100, and corresponding values for the protection parameters of the powered anode.

Additionally, FIG. 4 describes increasing a first value of a single protection parameter. However, in some embodiments, once the electronic processor 205 determines that the water heater 100 operates at a high duty cycle, the electronic processor 205 may increase the values for all of the protection parameters associated with the powered anode 180 without checking the duty cycle at every call for heat of the water heater 100. Rather, the electronic processor 205 uses increased values (for example, increased by about 30%) as the values for the protection parameters and only determines a new duty cycle value after the update period has expired, as described above.

After the electronic processor 205 determines the values for the protection parameters (for example, steps 315, 325), the electronic processor 205 may continue to evaluate the performance of the powered anode 180 to ensure that the water heater 100 is sufficiently protected. In some embodiments, the electronic processor 205 may periodically make a measurement indicative of the conductivity of the water and/or the conductivity of the powered anode 180 (for example, a measurement of the anode current or voltage) and compare the measurement to a target value. The electronic processor 205 may then adjust the applied voltage and/or current of the powered anode 180 to ensure the measurement reaches and remains at the target value. In other embodiments, the electronic processor 205, after operating the powered anode at the current values for the protection parameters or at the increased values, does not update the values used for the protection parameters until a new call for heat is received by the electronic processor 205. As discussed above, after the electronic processor 205 determines that the duty cycle of the water heater 100 exceeds the first threshold, every time a new value for a protection parameter is calculated and/or accessed from memory, the electronic processor 205 may automatically increase the original value for the protection parameter (for example, by approximately 30%).

Figure 5:
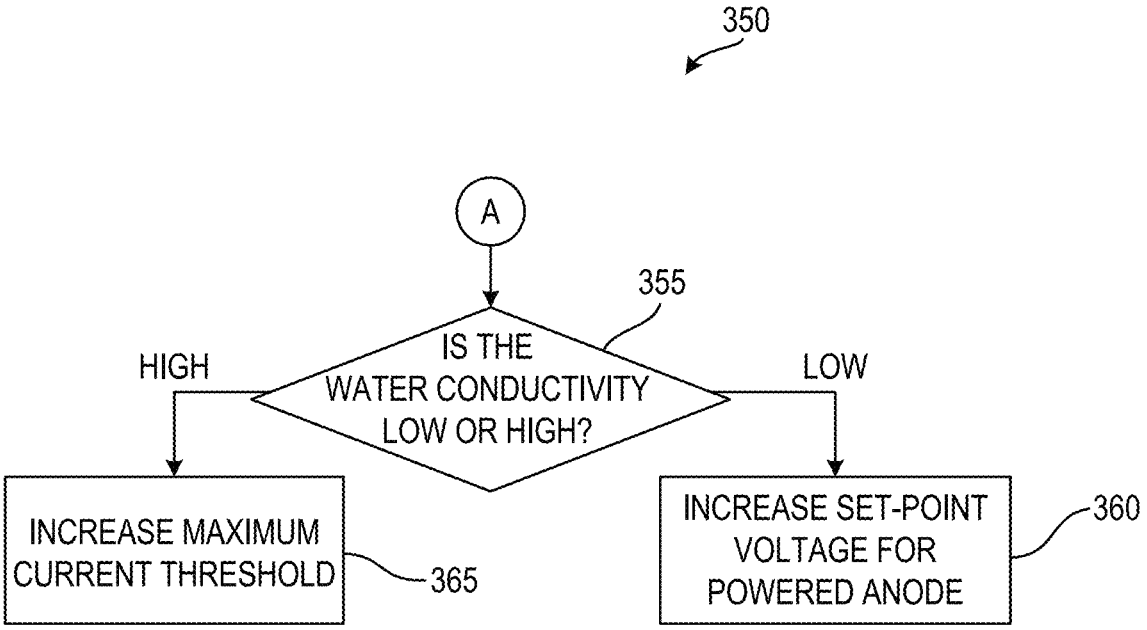
FIG. 5 is a flowchart of an enhanced control method of controlling a powered anode based on a duty cycle of the water heater of FIG. 1 according to some embodiments of the application.

The conductivity of the water in the water tank 105 also affects the corrosion rate of the water tank 105 and the flue 155. In low water conductivity conditions, the water tank 105 may be adequately protected with a lower anode current density, and the increased water resistance inherently reduces the anode currents. Therefore, a lower voltage is typically applied to the powered anode 180 (for example, based on typical control by the electronic processor 205). These lower anode currents, however, do not consider the increased risk of corrosion at the surface of the flue 155 in a water heater 100 operating at high duty cycles. Additionally, when the water heater 100 operates at a high duty cycle in high water conductivity conditions, the anode current quickly reaches a maximum current threshold. Therefore, the electronic processor 205 implements an enhanced version of the control algorithm of FIG. 4 that accounts for these marginal water conditions in which water heaters 100 may be under-protected. FIG. 5 is a flowchart of the enhanced control method 350, which follows steps 325 and 315 of FIG. 4, and begins by determining whether the water conductivity is low or high (step 355). The electronic processor 205 determines whether the water conductivity is low or high based on, for example, a typical or average water conductivity. In some embodiments, the electronic processor 205 determines the water conductivity by measuring the anode current and dividing by an incremental voltage (for example, a difference between an applied voltage to the powered anode 180 and an open circuit potential when no voltage is applied to the powered anode 180). In other embodiments, the electronic processor 205 determines the conductivity of the water using different methods. The electronic processor 205 may calculate a water conductivity quantity and compare the quantity to predetermined thresholds such as a low conductivity threshold and/or a high conductivity threshold. The water conductivities that are not below the low conductivity threshold and that do not exceed the high conductivity threshold may then be determined to be medium water conductivities by the electronic processor 205.

When the electronic processor 205 determines that the water conductivity is low, the electronic processor increases the setpoint voltage for the powered anode 180 (step 360). As discussed above, in low water conductivities and high duty cycles, the anode currents tend to be lower, thereby decreasing the protection to the water tank 105. By increasing the setpoint voltage, the powered anode 180 can more effectively protect portions of the water tank 105 that have higher average temperatures due to the high duty cycle of the water heater 100 (for example, the surface of the heat exchanger). When the electronic processor 205 determines that the water conductivity is high and the water heater 100 is operating at a high duty cycle, the electronic processor 205 increases the maximum current threshold such that a higher current can be applied to the powered anode 180 (step 365). Additionally, in some embodiments, the electronic processor 205 may determine that the water heater 100 operates in ultra-low water conductivity conditions. In such conditions, the electronic processor 205 operates the powered anode according to a minimum current threshold. When the water heater 100 operates at high duty cycles in such ultra-low water conductivity conditions, the electronic processor 205 increases the minimum current threshold to account for the increased risk of corrosion of the water tank 105.

Figure 6:
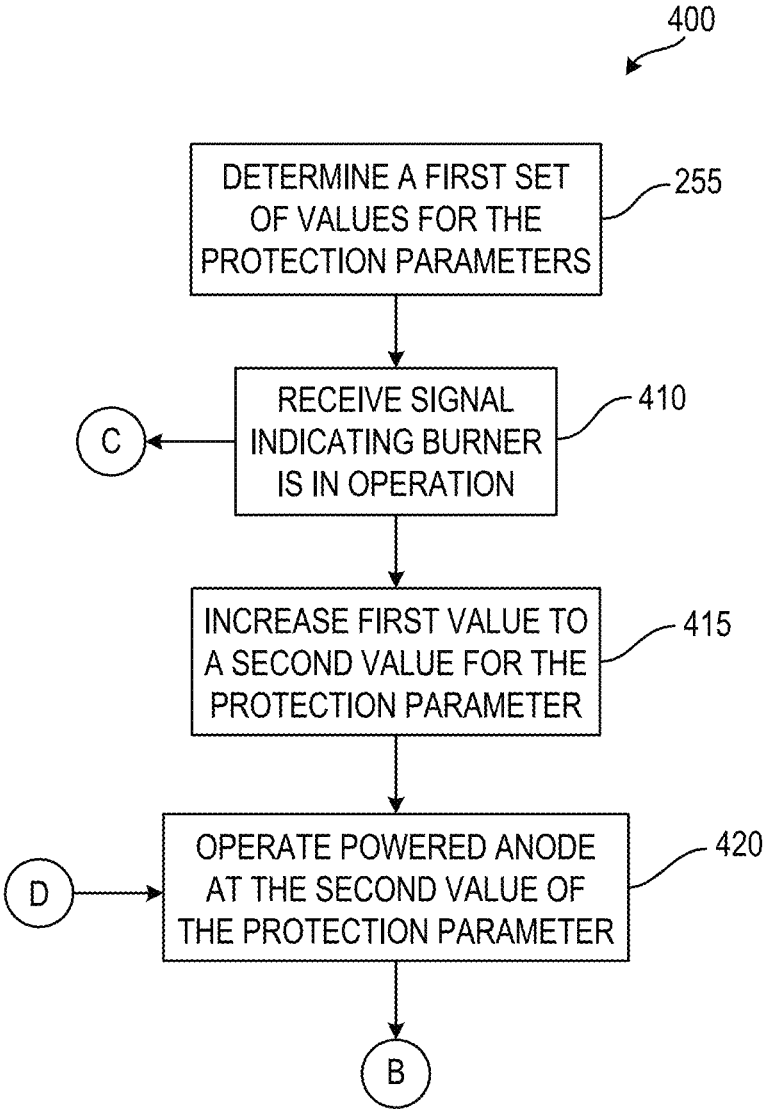
FIG. 6 is a flowchart of controlling a powered anode based on the operation of a burner of the water heater of FIG. 1 according to some embodiments of the application.

FIG. 6 is a flowchart illustrating another method 400 of changing the value for a protection parameter of the powered anode 180 as described with respect to step 260 of FIG. 3. In particular, FIG. 6 illustrates the method 400 of controlling the powered anode 180 based on the operation of the burner 160. As described above with reference to FIG. 3, the electronic processor 205 first determines a first value for a protection parameter of the powered anode 180 (step 255 of FIG. 3). The first value may be accessed from the memory 220 and may correspond to normal protection conditions. The electronic processor 205 then receives a signal indicating that the burner 160 is in operation (step 410). In some embodiments, the signal is received from the burner controller 225. In other embodiments, the signal is received from, for example, the flame sensor 170 or the burner 160 itself. As discussed above, during operation of the burner 160, the water tank 105 is at an increased risk of corrosion. Therefore, in response to receiving the signal indicating the burner 160 is in operation, the electronic processor 205 increases the first value to a second value for the protection parameter (step 415). For example, in some embodiments, the electronic processor 205 increases the setpoint voltage, thereby indirectly increasing the current applied to the powered anode 180. In other embodiments, the electronic processor 205 increases a maximum current threshold, thereby allowing for an overall greater amount of protection from the powered anode 180 (i.e., by increasing the maximum current applied to the powered anode 180). In one embodiment, the setpoint voltage is increased by approximately 0.3V. Such an increase in the setpoint voltage may increase the current applied to the powered anode 180 by approximately 30%. The electronic processor 205 then operates the powered anode 180 at the second value of the protection parameter (step 420) to provide greater protection when the burner 160 is in operation. By increasing the value of at least one protection parameter when the burner 160 is in operation, the powered anode 180 is more effective at protecting the hot surfaces of the flue 155 that become more prone to corrosion when the burner 160 is in operation.

As mentioned above, after the electronic processor 205 determines the values of the protection parameters (for example, step 420), the electronic processor 205 may periodically determine whether the powered anode 180 operates at a target level, or may, in other embodiments, determine new values (and new increased values) of the protection parameters when a new call for heat is received.

Figure 7:
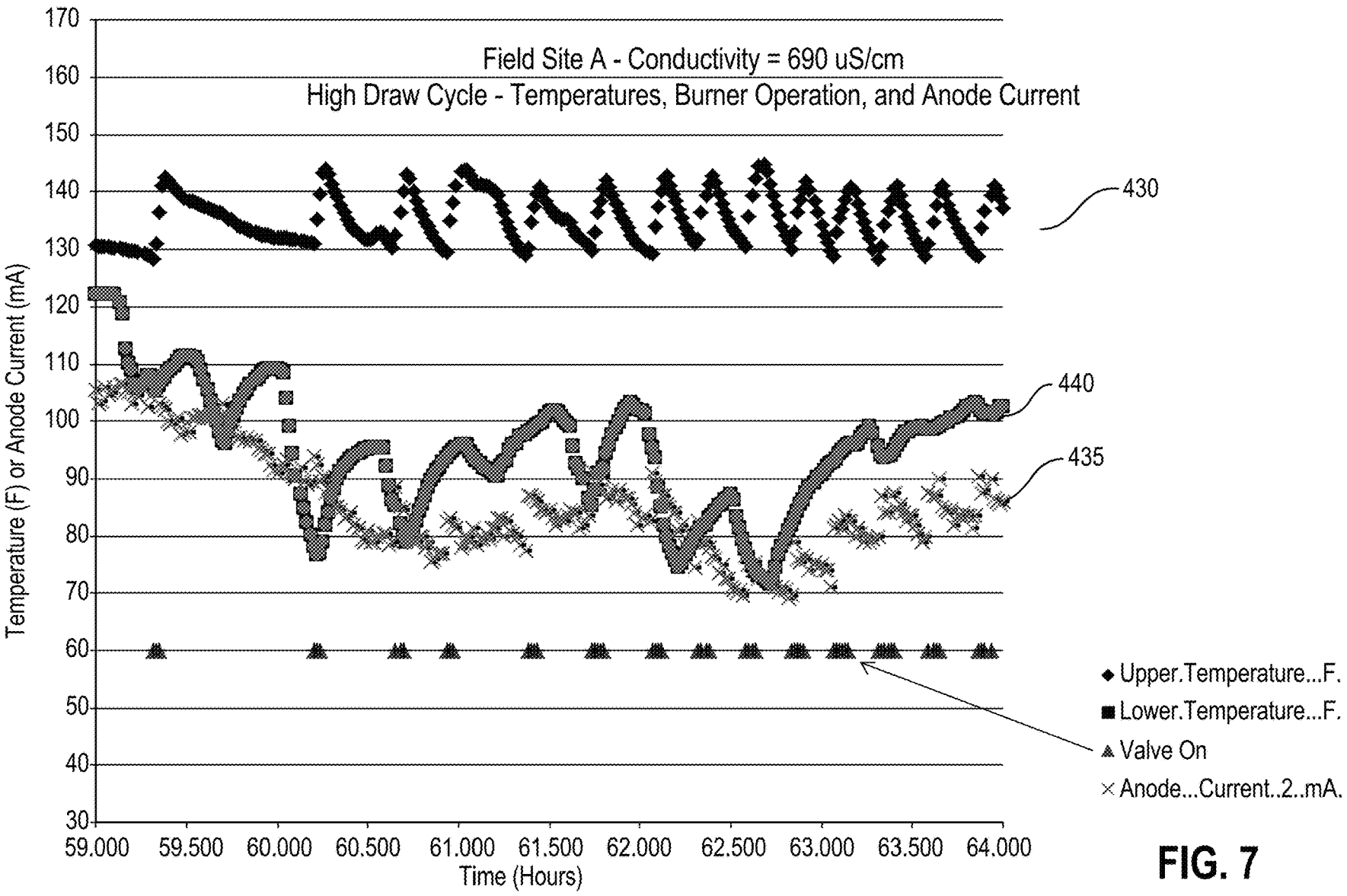
FIG. 7 is a graph illustrating a decrease in anode current as a lower temperature of the water tank of the water heater of FIG. 1 decreases.

In some conditions, however, increasing the protection parameters when the burner is in operation, does not provide sufficient increased protection of the water tank 105. One such condition includes a water heater 100 that is in operation and sustains a large draw of water. During a large draw of water from the water tank 105, a temperature (and in particular, a lower temperature) of the water in the water tank 105 significantly decreases. A decrease in water temperature typically results in a lower powered anode current. FIG. 7 is a graph 430 illustrating a decrease in anode current 435 as a lower temperature 440 of the water tank 105 decreases.

A drop in temperature while the water heater 100 is in a standby mode may not affect the protection of the water heater 100 significantly. When the burner 160 is in operation, however, the water heater 100 remains at an increased risk of corrosion. Therefore, the electronic processor 205 implements a method 450 (FIG. 8) to ensure that the voltage applied to the powered anode 180 is increased when a large draw occurs during operation of the burner.

Figure 8:
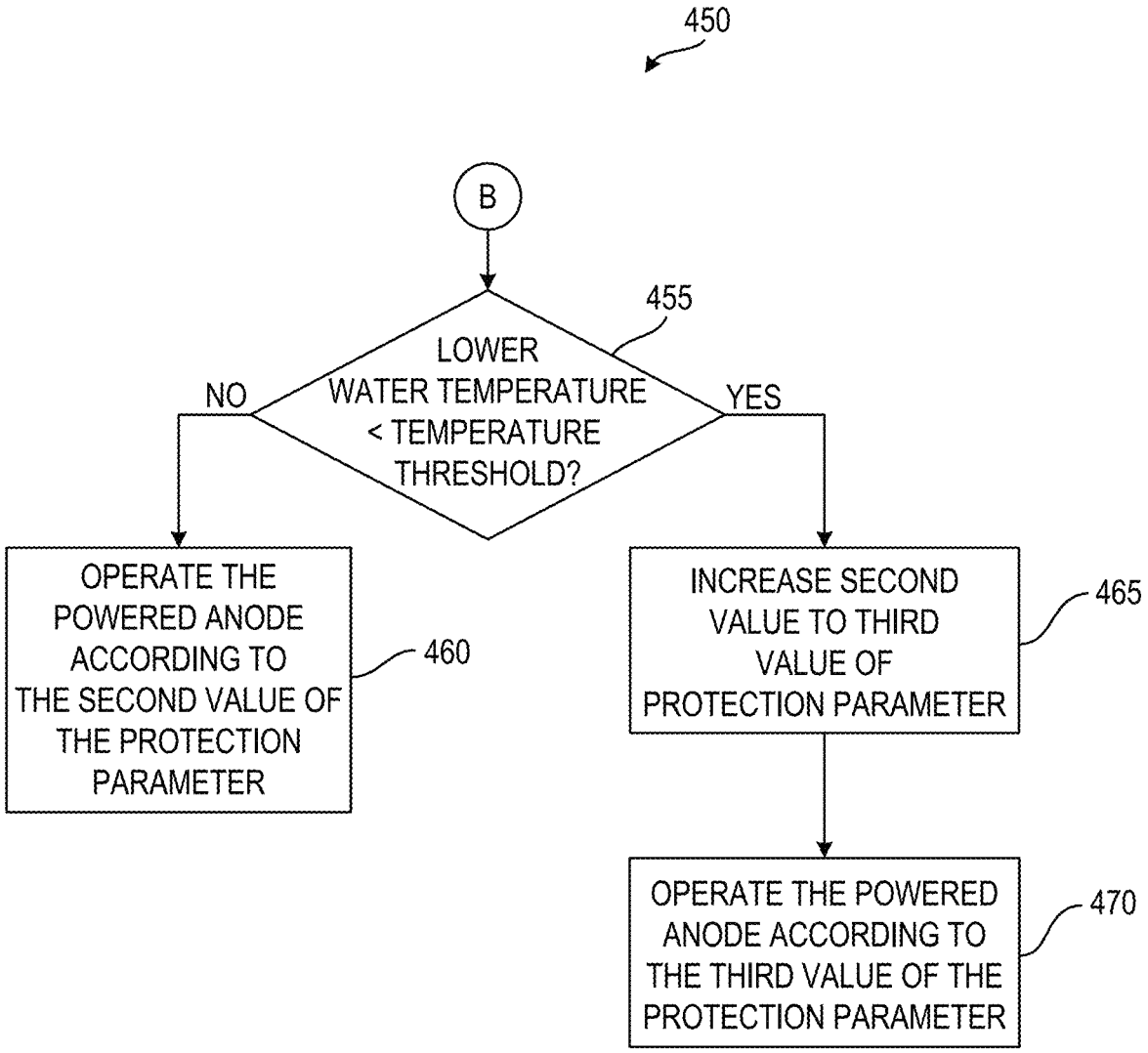
FIG. 8 is a flowchart implementing a method of controlling a powered anode based on a lower temperature of the water in the water tank of the water heater of FIG. 1 according to some embodiments of the application.

FIG. 8 is a flowchart implementing the method 450 of controlling the powered anode 180 based on a lower temperature of the water in the water tank 105. The method 450 of FIG. 8 follows from the method described above with respect to FIG. 6. In particular, the method 650 of FIG. 8 is implemented after the electronic processor 205 has already increased the first value of the protection parameter to the second value of the protection parameter (step 415 of FIG. 6). In other words, the method 450 of FIG. 8 is implemented in situations in which the burner 160 is in operation and in which the lower temperature of the water in the water tank 105 decreases (for example, due to a large draw). The electronic processor 205 periodically receives a temperature signal indicative of a lower temperature of the water tank 105 (step 455). In the illustrated embodiment, the water heater 100 may include a temperature sensor positioned in a bottom portion of the water tank 105 such that the measurements from the temperature sensor are indicative of a lower temperature of the water tank 105. The electronic processor 205 may receive the temperature signals periodically (for example, approximately once per minute) for general control of the water heater 100 (for example, when to activate the burner 160). The electronic processor 205 determines whether the lower temperature is below a temperature threshold (step 460). The temperature threshold is indicative of a lower temperature typical of large amounts of cold water entering the water tank 105 due to a large draw of water. For example, in some embodiments, the temperature threshold may be approximately 30° F. lower than a user-defined temperature setpoint. In other embodiments, the temperature threshold is a predetermined temperature (for example, not based on the user-defined setpoint), and may be, for example, 90° F.

While the lower temperature remains above the temperature threshold, the electronic processor 205 continues to operate the powered anode at the second value of the protection parameter (step 465). On the other hand, when the electronic processor 205 determines that the lower temperature is below the temperature threshold, the electronic processor 205 increases the second value to a third value for the protection parameter (step 470), and operates the powered anode 180 at the third value of the protection parameter (step 475). In the illustrated embodiment, the temperature threshold corresponds to 110° F. In other embodiments, however, the temperature threshold may be lower or higher than 110° F. Additionally, in some embodiments, the increase from the second value to the third value of the protection parameter may be, for example, a 30% increase.

Figure 9:
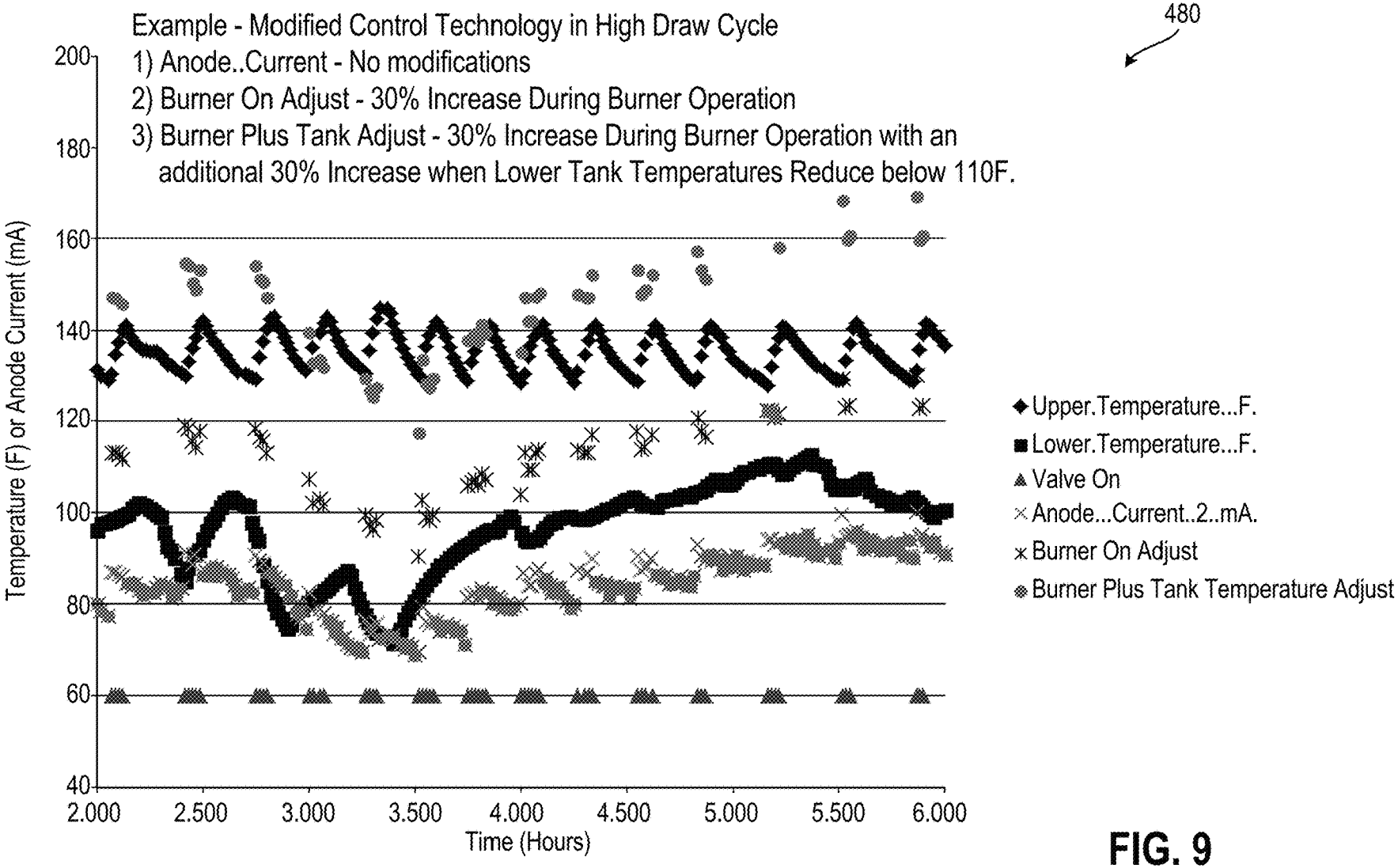
FIG. 9 is a graph illustrating exemplary implementations of some of the methods described above.

FIG. 9 is a graph 480 illustrating how the method 400 of FIG. 6 and the method 450 of FIG. 8 change the anode current. As shown in the graph 480, not changing the values of the protections parameters at all (labeled as "Anode . . . Current" on the graph) causes the anode current to be significantly low (approximately 85 mA). The graph 480 also shows that implementing method 400 of FIG. 6 by itself increases the anode current to a range of approximately 95-120 mA (labeled as "Burner On Adjust"). Finally, implementing method 450 of FIG. 8 along with method 400 of FIG. 6 increases the anode current to above 140 mA (labeled as "Burner plus Tank Temp Adjust"), which more adequately protects the water tank 105 from corrosion.

Figure 10:
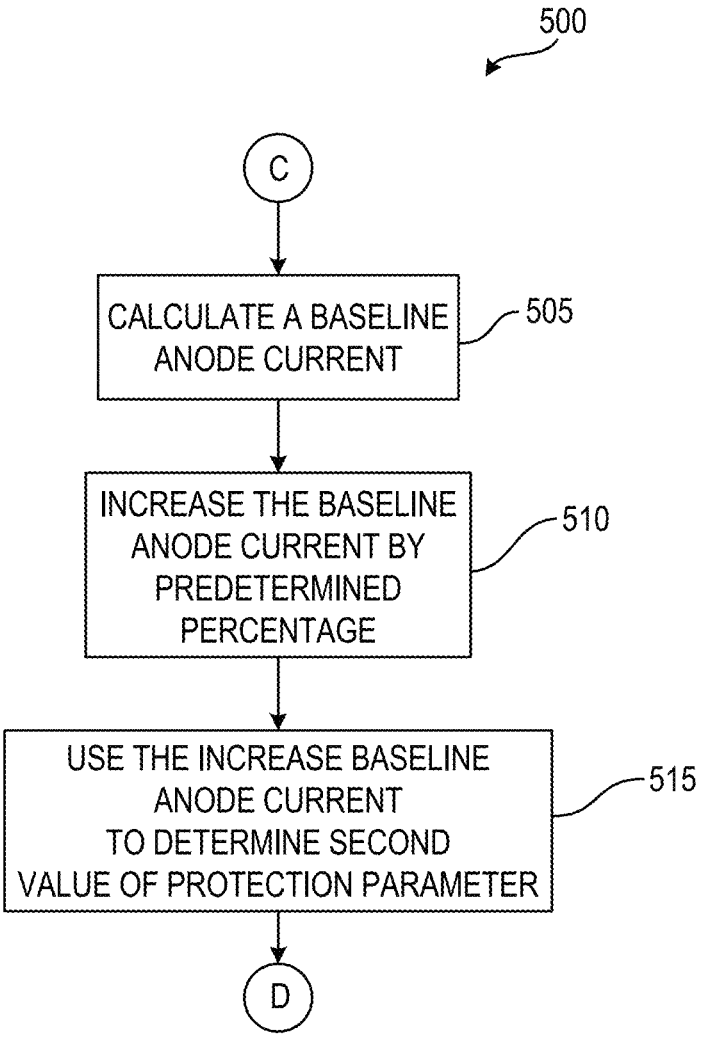
FIG. 10 is a flowchart of a method of increasing a first value of a protection parameter to a second value of the protection parameter of the powered anode of the water heater of FIG. 1 according to some embodiments of the application.

FIG. 10 is a flowchart of a method 500 of increasing the first value of the protection parameter to a second value of the protection parameter as discussed in step 415 of FIG. 6. As discussed above, the change from the first value to the second value of the protection parameter includes increasing the first value by approximately 30%. In other words, as discussed above, the second value is approximately 30% higher than the first value. On the other hand, the method 500 of FIG. 10 increases the first value based on a baseline anode current (also referred to as a standby current). The baseline current is calculated by the electronic processor 205 during long periods of inactivity for the burner 160 such as, for example, throughout the night when the burner 160 is minimally activated, and/or during a pre-purge or post-purge state of the water heater 100, and the like. Increasing to the second value based on the baseline anode current may be more effective at reaching an anode current that provides adequate protection of the water tank 105 without monitoring for the lower temperature of the water tank 105.

As show in FIG. 10, the method 500 starts by determining a baseline current (step 505). Several methods may be used to determine the baseline current and are discussed in more detail with respect to FIGS. 13-15. After the electronic processor 205 receives a signal that the burner 160 is in operation (step 410 of FIG. 6), the electronic processor 205 increases the baseline current by a predetermined percentage (step 510). In the illustrated embodiment, the predetermined percentage includes 30%, such that increased anode current is approximately 30% higher than the baseline current. The electronic processor 205 may then use the increased anode current to determine the second value of the protection parameter (step 515). For example, the electronic processor 205 may determine what voltage should be applied to the powered anode 180 to achieve the increased anode current. The electronic processor 205 then proceeds to using the second value of the protection parameter to operate the powered anode 180 as described above with respect to step 420 of FIG. 6.

Figure 11:
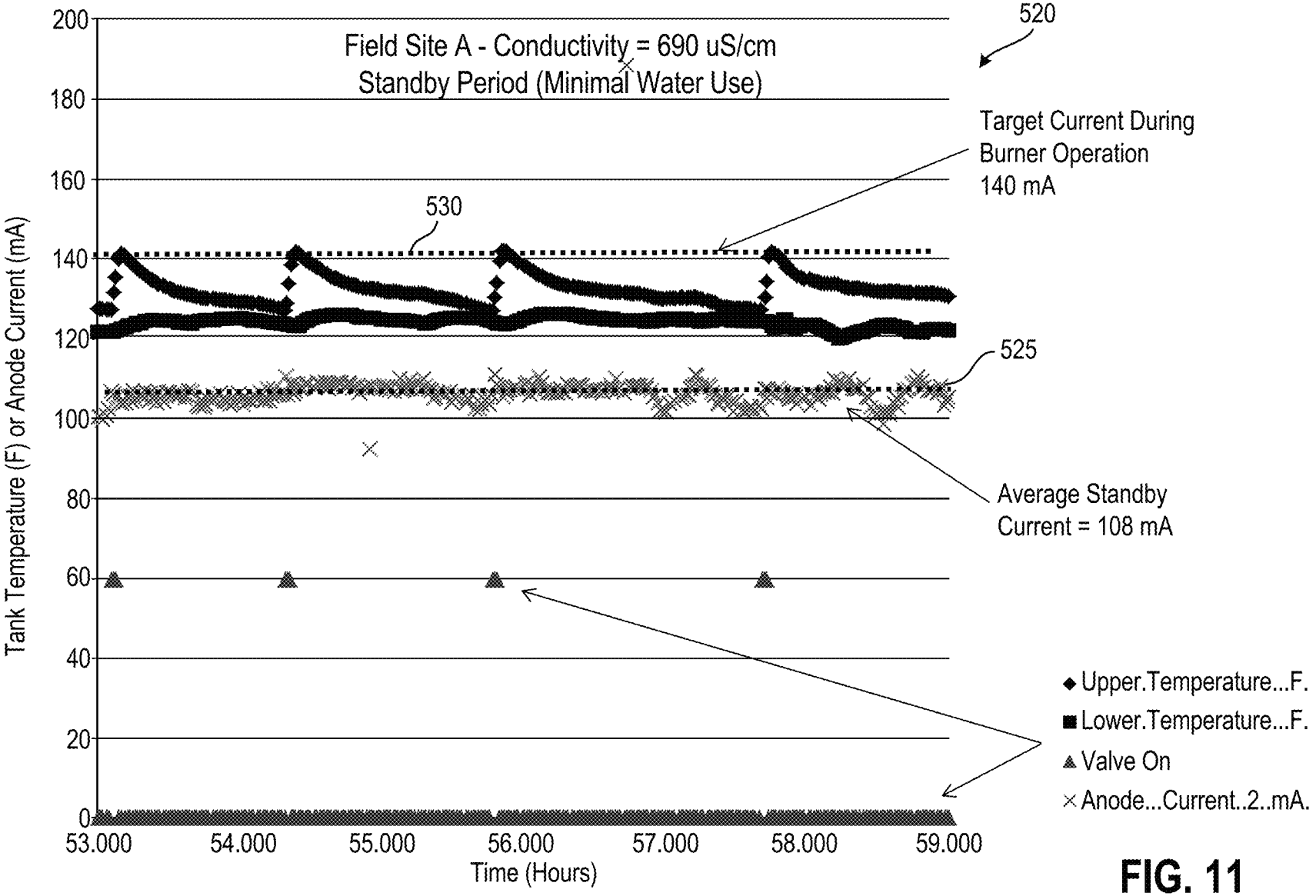
FIG. 11 illustrates a graph showing an average baseline current for the water heater of FIG. 1 and a target anode current according to some embodiments of the application.

FIG. 11 illustrates a graph 520 showing an average baseline current 525 for a water heater 100 and a target anode current 530 obtained by increasing the baseline current by approximately 20%, as described above. As shown in FIG. 11, by increasing the anode current based on a baseline current instead of a previously determined anode current (or other parameters) for specific water conditions, the electronic processor 205 does not need to monitor the lower temperature of the water tank 105 as described above with respect to FIG. 8. Additionally, FIG. 12 is a chart comparing the different methods discussed with respect to FIGS. 6, 8, and 10. In particular, the chart shows that increasing the protection parameters considering both burner operation and lower tank temperatures (for example, the method of FIG. 8) results in an average protective current of approximately 147 mA during high demand burner operation that is similar to the target anode current 530 during standby operation. Additionally, the chart shows that when the lower temperature is not taken into account (for example, the electronic processor 205 performs the method of FIG. 6 only), the powered anode 180 is operated at a significantly lower anode current (for example, 114.2 mA instead of 147.3 mA when the lower temperature is considered).

Figure 13:
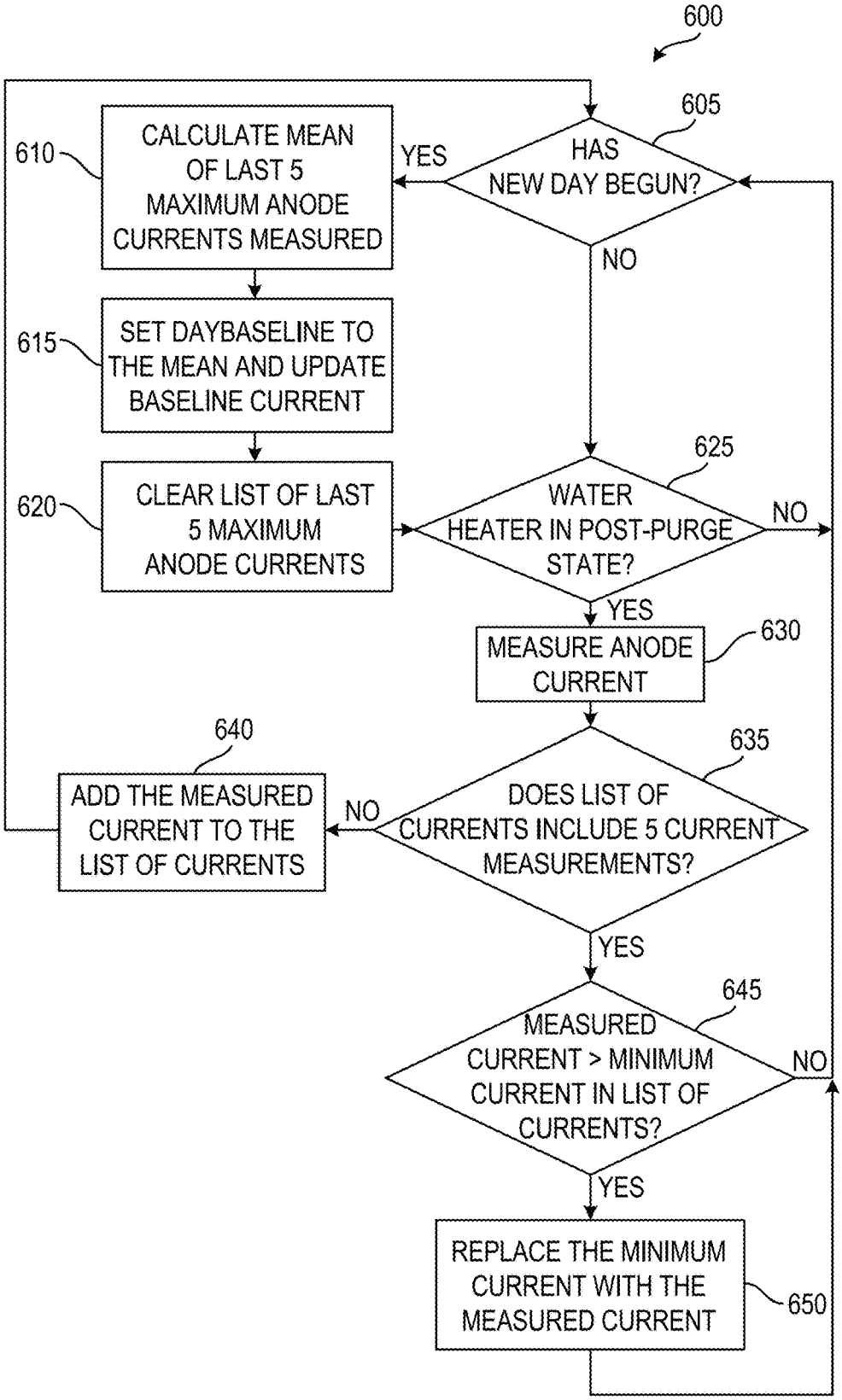
FIG. 13 is a flowchart illustrating a method of determining the baseline anode current during a post-purge state of the water heater of FIG. 1 according to some embodiments of the application.
Figure 14:
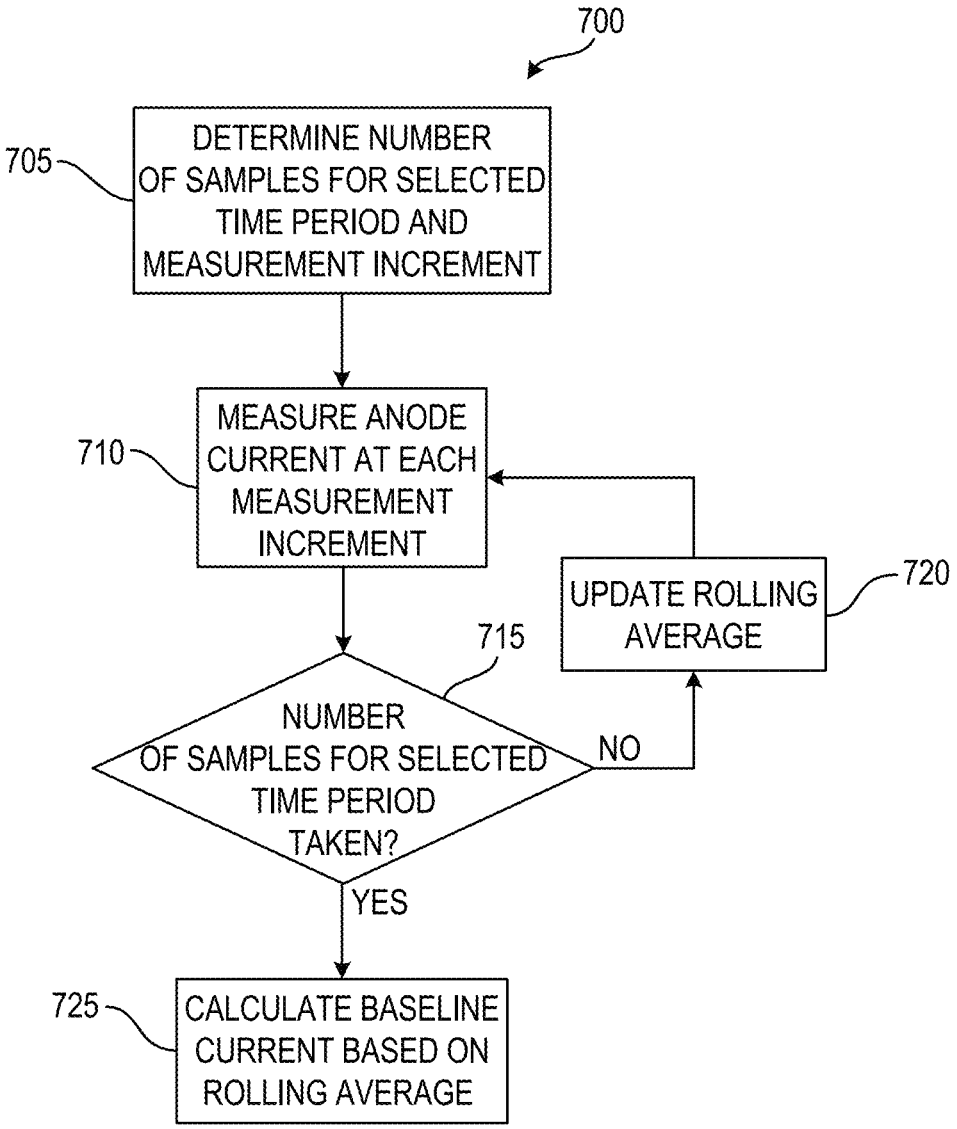
FIG. 14 illustrates another method of determining the baseline anode current of the water heater of FIG. 1 according to some embodiments of the application.
Figure 15:
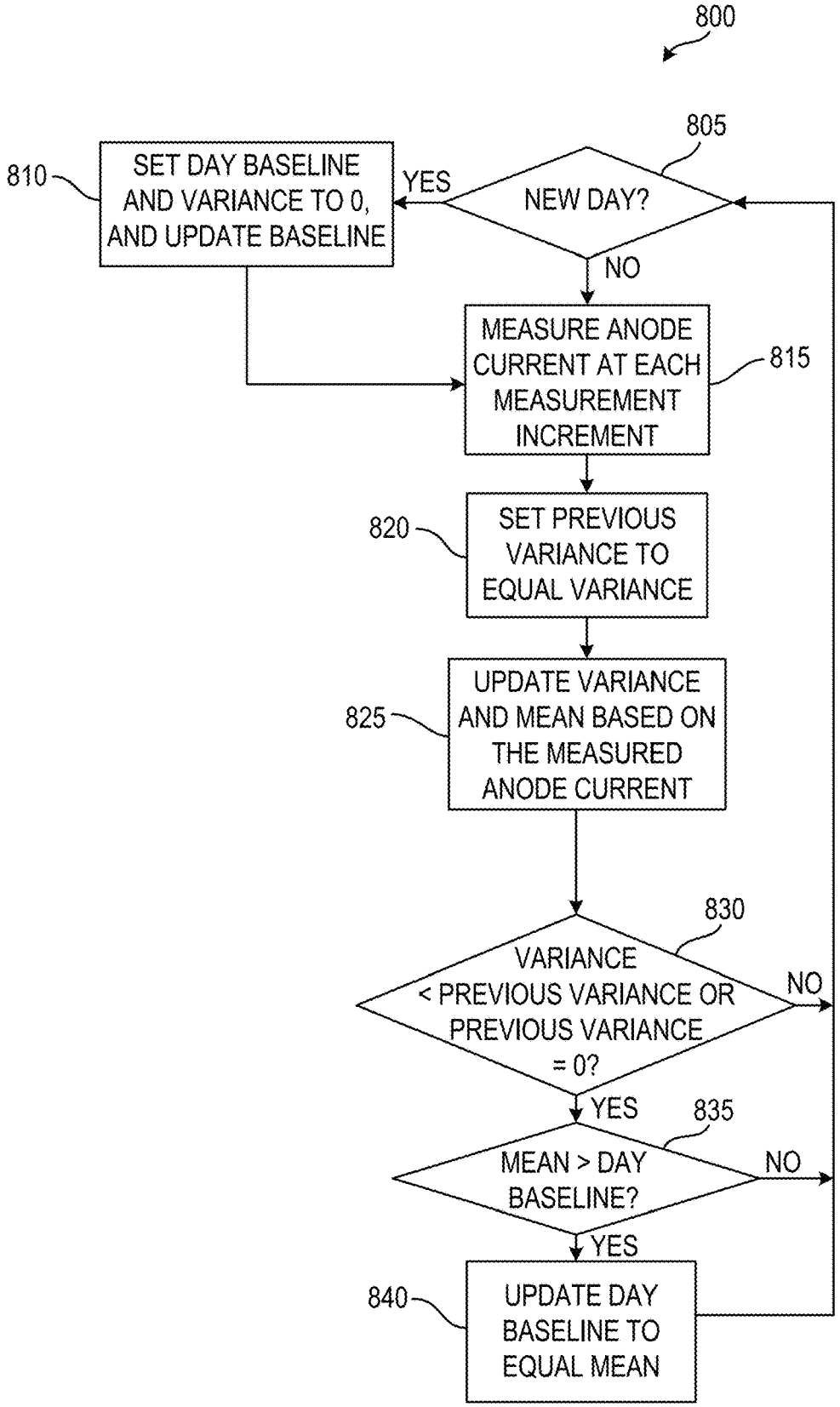
FIG. 15 is a flowchart illustrating another method of determining the baseline anode current based on the mean and variance of the anode current according to some embodiments of the application.

FIGS. 13-15 illustrate different methods of determining the baseline current as referred to in step 505 of FIG. 10. FIG. 13 is a flowchart illustrating a method 600 of determining the baseline current during a post-purge state of the water heater 100. First, the electronic processor 205 determines whether a new day has begun (step 605). When a new day has begun, the variable Daybaseline is calculated based on a list storing 5 maximum anode currents previously measured. The electronic processor 205 calculates a mean of the last 5 maximum anode currents in the list (step 610). The electronic processor 205 then updates the variable Daybaseline to the mean calculated in step 610, and updated the baseline current (step 615). Once the baseline current was updated, the electronic processor 205 clears the list of currents, so a new list can be created (step 620). In some embodiments, more or less than 5 maximum currents are stored in the list.

Referring back to step 615, the electronic processor 205 updates the baseline current by the following equations:

$$\text{baseline current}=\text{baseline current}-\text{baseline current}/7$$

$$\text{baseline current}=\text{baseline current}+(\text{Daybaseline}/7)$$

These equations, however, assume that the baseline current values are known for the last seven days (thus the use of 7 in the denominator). Therefore, when the known baseline values span less than seven days, the equations used by the electronic processor 205 change slightly, and the electronic processor 205 calculates the baseline current using the following equation instead:

$$\text{baseline current}=\text{baseline current}+((\text{Daybaseline}-\text{baseline})/(\text{number of days}))$$

where the number of days corresponds to the number of days for which baseline current information is known plus one. As seen in the equations above, the variable Daybaseline is used to calculate the baseline current.

The electronic processor 205 then determines whether the water heater 100 is in a post-purge state (step 625). When the electronic processor 205 determines that the water heater 100 is not in the post-purge state, the electronic processor 205 proceeds to step 605 until the water heater 100 enters the post-purge state or a new day begins. When the electronic processor 205 determines that the water heater 100 is in the post-purge state, the electronic processor 205 measures the anode current (step 630) with, for example, a current sensor. A post-purge state occurs after the burner 160 stops firing and the blower 157 continues to operate to clean the combustion products out through the exhaust structure 150. The electronic processor 205 measures the anode current during the post-purge state because the water in the water tank 105 is at a maximum, steady-state temperature (because it has just been heated by the burner 160), but the burner 160 is not in operation.

After measuring the current, the electronic processor 205 determines whether the list of currents include 5 measurements (step 635). When the list of currents does not yet have 5 measurements, the electronic processor 205 adds the measured current (from step 630 to the list of currents (step 640), and then returns to step 605 to wait for another post-purge period. Otherwise, when the list of currents already includes 5 measurements, the electronic processor 205 determines whether the measured current is greater than the minimum current in the list of currents (step 645). When the measured current is greater than the minimum current in the list of currents, the electronic processor 205 replaces the minimum current of the list of currents with the measured current (step 650). By replacing the minimum current with the measured current when the measured current is greater than the minimum current, the list continues to store the maximum 5 anode currents. When the measured current is not greater than the minimum current in the list of currents, the electronic processor 205 proceeds back to step 605 and waits for another post-surge state to measure another anode current. Therefore, at the end or the beginning of each day a new baseline current is calculated based on the 5 highest anode currents previously measured.

FIG. 14 illustrates another method of determining the baseline current as referred to in step 505 of FIG. 10. In particular, FIG. 14 is a flowchart illustrating a method 700 of determining the baseline current using a rolling average calculated over a selected time period and at a selected measurement increment. First, the electronic processor 205 determines the number of samples for a selected time period and measurement increment (step 705). In one example, the time period to average over is one week, and the measurement increment is once per minute. In other words, the electronic processor 205 measures the anode current once per minute and averages these measurements over one week to determine the baseline current. In this example, the number of samples correspond to 10,080 samples. The electronic processor 205 then measures the anode current at each measurement increment (step 710). In this example, the electronic processor 205 measures the anode current once every minute. The electronic processor 205 then determines whether the number of samples for the selected time period (for example, the desired number of samples) have been taken (step 715). In other words, the electronic processor 205 determines whether a current number of samples taken is less than the desired number of samples. When less than the desired number of samples (for example, samples for one week) have been collected, the electronic processor 205 then updates a rolling average using the measured anode current (step 720). In particular, the electronic processor 205 calculates the rolling average when less than N samples have been collected by performing the following calculation:

average=average+(anode current measurement−average/*n*)

where n is the current number of samples.

When the electronic processor 205 determines that the number of samples for the selected time period have been taken, the electronic processor 205 uses the rolling average to calculate the baseline current (step 725). The electronic processor 205 performs the following two-step average calculation to determine the baseline current for the water heater 100:

average=average−(average/*N*)

average=average+((anode current measurement)/*N*)

where N is the desired number of samples to average over. In some embodiments, these equations are then used by the electronic processor 205 for the remaining installation time of the water heater 100. As shown in the two equations immediately above, the currently calculated average is used to calculate the baseline, such that the baseline is recalculated every minute (at each measurement increment). In some embodiments, the rolling average continues to be updated while the burner 160 is in operation using values before the adjustments described by FIGS. 3-12.

FIG. 15 is a flowchart illustrating a method 800 of determining the baseline current based on the mean and variance of the anode current. The electronic processor 205 determines whether a new day has begun (step 805). When the electronic processor 205 determines a new day has begun, the electronic processor initializes the variables DayBaseline and Variance, and updates the baseline current (step 810), and the electronic processor 205 then proceeds to step 815. The electronic processor updates the baseline current as described above with respect to FIG. 13. Otherwise, when the electronic processor 205 determines a new has not begun, the electronic processor 205 proceeds to step 815. At step 815, the electronic processor 205 measure the anode current. In the illustrated embodiment, the electronic processor 205 measures the anode current once every minute. The electronic processor 205 then also sets the variable PreviousVariance to the value of Variance (step 820). The electronic processor 205 then updates both the mean and the variance of the anode currents based on the measured anode current (step 825).

The electronic processor 205 updates the mean and variance according to the following equations:

Mean=mean−(mean/60)

Mean=mean+(current measurement/60)

Variance=variance−(variance/60)

Variance=((current measurement−mean)/60)^2 where current measurement refers to the current measured at step 815 of FIG. 15. The equations above, however, assume that a current measurement is taken every minute (and thus use a denominator of 60). However, when a new day has recently begun and a full hour has not yet elapsed, the equations are changed slightly to account for the fact that less than 60 anode current measurements have been taken. When the water heater 100 has been operating for less than one hour during the day, the electronic processor 205 uses the following equations to update the mean and variance of the anode currents:

Mean=mean+((current measurement−mean)/number of samples taken)

Variance=variance+(((current measurement−mean)^2)/(60×(number of samples taken+1))

After the electronic processor 205 updates the mean and variance, the electronic processor 205 determines whether the updated variance is less than the variable PreviousVariance or whether PreviousVariance is set to zero (step 830). The electronic processor 205 determines that the previous variance is set to zero on the first implementation of the method 800 of FIG. 15 for the day, since at step 810, the variance was set to zero, and then at step 820 the previous variance was set to the value of variance (zero). When the electronic processor 205 determines that the updated Variance is greater than the previous variance and the previous variance is not set to zero, the electronic processor 205 returns to step 805 to continue measuring the anode currents. On the other hand, when the electronic processor 205 determines that the updated variance is less than the previous variance or that the previous variance is set to zero, the electronic processor 205 proceeds to determine whether the mean is greater than the variable Daybaseline (step 835).

When the electronic processor 205 determines that the mean is not greater than the variable Daybaseline, the electronic processor 205 proceeds to step 805 to continue measuring anode currents. On the other hand, when the electronic processor 205 determines that the mean is greater than the variable Daybaseline, the electronic processor 205 sets the variable Daybaseline to the mean (step 840). As discussed above, Daybaseline is then used to calculate the baseline current.

Figure 16:
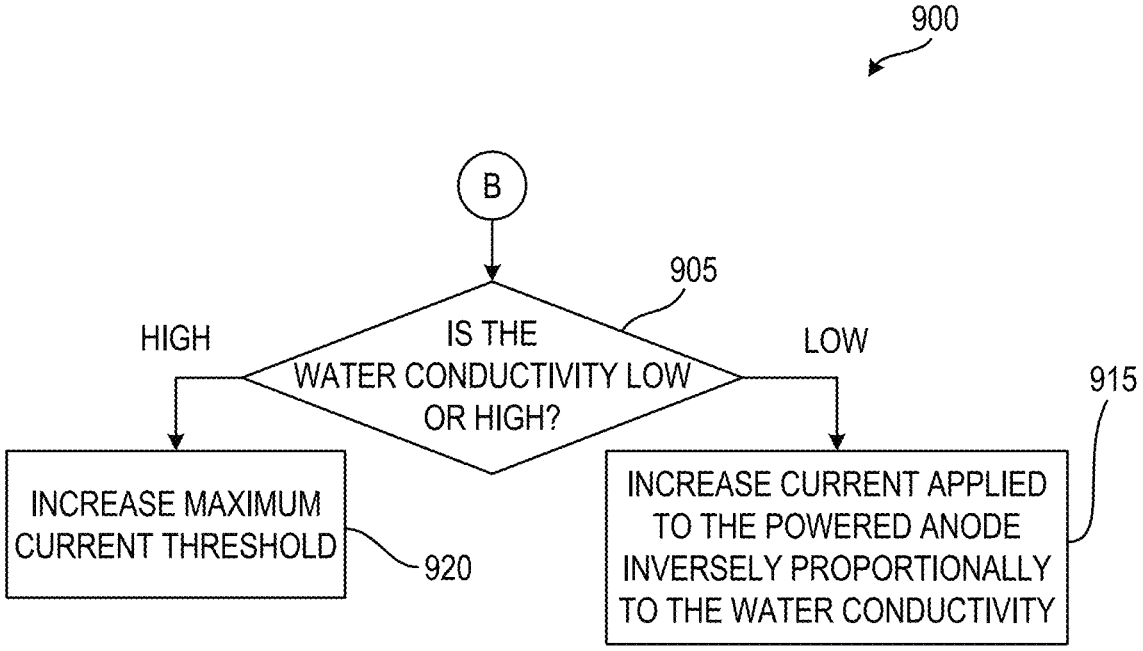
FIG. 16 is a flowchart of the enhanced control method of controlling a powered anode based on the operation of a burner of the water heater of FIG. 1 according to some embodiments of the application.

As discussed above, the conductivity of the water in the water tank 105 may also affect the corrosion rate of the water tank 105 and of the flue 155. As mentioned with respect to FIG. 5, the lower anode currents typically used in low water conductivity conditions do not consider the increased risk of corrosion due to high duty cycles of the water heater and/or operation of the burner 160, and in high water conductivity conditions, the anode current quickly reaches a maximum current threshold. Therefore, the electronic processor 205 implements an enhanced version of the control algorithm of FIG. 6 that accounts for these marginal water conditions in which water heaters 100 may be unprotected. FIG. 16 is a flowchart of the enhanced control method 900, which follows step 420 of FIG. 6, and being by determining whether the water conductivity is low or high (step 905). In some embodiments, the electronic processor 205 determines a relative water conductivity by determining whether the water conductivity is low, medium, or high. In the illustrated embodiment, the electronic processor 205 determines whether the water conductivity is low or whether the water conductivity is high, but does not classify water conductivities between the low threshold and the high threshold. Various methods may be employed for determining the conductivity of the water such as, for example, by dividing the applied current to the powered anode 180 by an incremental voltage. The incremental voltage may be, for example, an applied voltage minus an open circuit potential measured for the powered anode 180, or may be calculated based on different voltages. The result may then be compared to different thresholds to determine a relative conductivity of the water. For example, the electronic processor 205 may compare the result to a high conductivity threshold and/or a low conductivity threshold to determine whether the conductivity of the water is low, medium, or high. In other embodiments, different methods of determining the relative conductivity of the water may be used.

When the electronic processor 205 determines that the water conductivity is low (e.g., as compared to a normal or medium water conductivity), the electronic processor 205 increases the current applied to the powered anode 180 inversely proportionally to the low water conductivity (step 915). For example, as the water conductivity decreases, the electronic processor 205 increases the current applied to the powered anode 180 (to counteract a typical decrease in anode currents in low conductivity conditions). The increase in the applied current increases the protection provided by the powered anode 180 in low conductivity states such that the surface of the flue 155 can be better protected.

On the other hand, when water conductivity is high, the anode current is more likely to reach the maximum current threshold quickly. The maximum current threshold limits the protection the powered anode 180 is able to provide to the water tank 105. Therefore, when the electronic processor 205 determines that the water conductivity is very high (e.g., greater than 400 μS/cm), the electronic processor 205 increases the maximum current threshold (step 920). By increasing the maximum current threshold, the electronic processor 205 improves available protection during operation of the burner 160. Additionally, in some embodiments, the electronic processor 205 may determine that the water heater 100 operates in ultra-low water conductivity conditions. In such conditions, the electronic processor 205 operates the powered anode according to a minimum current threshold. When the burner 160 operates in such ultra-low water conductivity conditions, the electronic processor 205 increases the minimum current threshold to account for the increased risk of corrosion of the water tank 105. The method 900 of FIG. 16 may also continue such that the electronic processor 205 may periodically determine whether the powered anode 180 operates at a target level, or may, in some embodiments, determine a new set of values of the protection parameters when a new call for heat is received.

The methods 300 and 350 of FIGS. 4 and 5, respectively perform intermittent data transfer between the electronic processor 205 and the burner controller 225 to determine the duty cycle of the water heater 100. On the other hand, the methods 400, 450, and 900 of FIGS. 6, 8, and 16 perform continuous (e.g., more frequent) data transfer between the electronic processor 205 and the burner controller 225 to receive up-to-date data regarding the activation state of the burner 160 and the lower temperature of the water tank 105.

Figure 17:
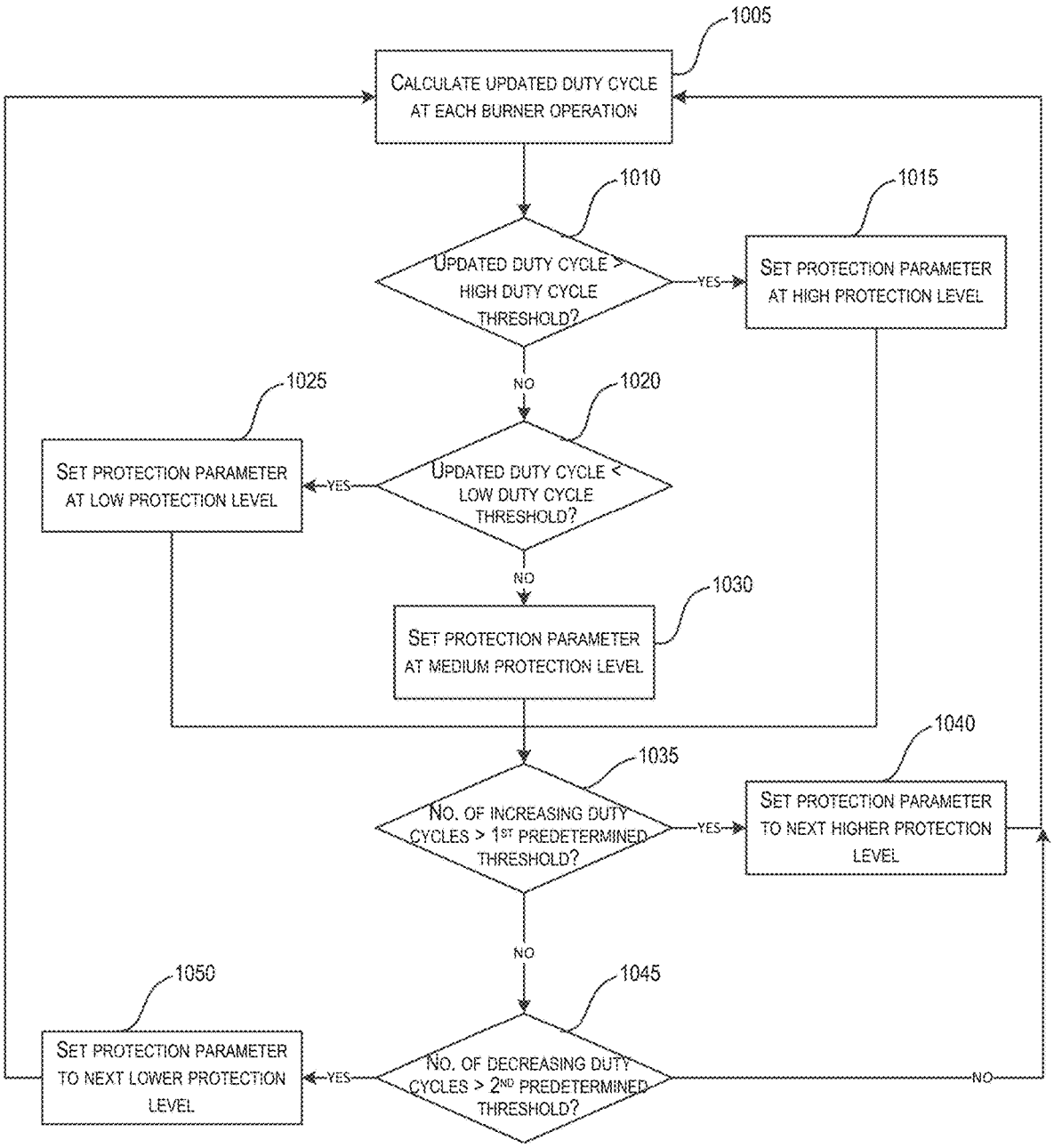
FIG. 17 is a flowchart of another control method of controlling a powered anode based on the duty cycle of the burner of the water heater of FIG. 1.

FIG. 17 is a flowchart of another control method 1000 of the powered anode 180 implemented by the electronic processor 205. At step 1005, the electronic processor 205 calculates an updated duty cycle with each new burner operation. By determining the duty cycle of the water heater 100 at each new operation of the burner 160, the duty cycle remains as current as possible. The electronic processor 205 then determines whether the updated duty cycle is greater (in some embodiments, greater or equal to) a high duty cycle threshold (step 1010). In the illustrated embodiment, the high duty cycle threshold corresponds to 25%. In other embodiments, the high duty cycle threshold may be different. When the electronic processor 205 determines that the updated duty cycle is greater than the high duty cycle threshold, the electronic processor 205 sets the protection parameter for the powered anode 180 at a high protection level (step 1015). In one example, the electronic processor 205 sets the maximum current of the powered anode 180 at a high maximum current level. The high maximum current level may correspond to, for example, 400 milliamps (ma).

When the electronic processor 205, however, determines that the updated duty cycle remains below the high duty cycle threshold (for example, is less than approximately 25%), the electronic processor 205 then determines whether the updated duty cycle is below a low duty cycle threshold (step 1020). In the illustrated embodiment, the low duty cycle threshold corresponds to approximately 10%, though in other embodiments, the low duty cycle threshold may be different. When the electronic processor 205 determines that the updated duty cycle is below the low duty cycle threshold, the electronic processor 205 sets the protection parameter at a low protection level (step 1025). For example, the electronic processor 205 sets the maximum current for the powered anode 180 at a low current level such as, for example 200 mA. In other embodiments, the low protection level may correspond to a different maximum current. When the electronic processor 205 determines that the updated duty cycle is not below the low duty cycle threshold, the electronic processor 205 sets the protection parameter at a medium protection level (step 1030). The medium protection level is lower than the high protection level and higher than the low protection level. In the illustrated embodiment, the medium protection level corresponds to 300 ma.

After the electronic processor 205 sets the protection level based on the updated duty cycle at steps 1015, 1025, 1030, the electronic processor 205 determines whether the number of increasing duty cycles is greater than a first predetermined threshold (step 1035). That is, the electronic processor 205 determines how many times the updated duty cycle is greater than the old duty cycle (i.e., the duty cycle before the last operation of the burner 160). The electronic processor 205 then compares the number of times that the updated duty cycle has increased to the first predetermined threshold. In one example, the electronic processor 205 determines whether there have been at least two increasing duty cycles (e.g., the first predetermined threshold corresponds to two). In some embodiments, the electronic processor 205 analyzes only the last set of updates to the duty cycle corresponding to the first predetermined threshold and determines whether both updates increased the duty cycle. For example, when the first predetermined threshold corresponds to two, the electronic processor 205 may determine whether the last two updates to the duty cycle increased the duty cycle.

When the electronic processor 205 determines that the number of increasing duty cycles is greater (or equal to) the first predetermined threshold, the electronic processor 205 sets the protection parameter to the next higher protection level (step 1040). For example, if the protection parameter had originally been set to the low protection level (e.g., at step 1025), the electronic processor 205 increases the protection parameter to the medium protection level (e.g., the electronic processor 205 increases the maximum current from 200 mA to 300 mA). Similarly, if the protection parameter had originally been set to the medium protection level (e.g., at step 1030), the electronic processor 205 increases the protection parameter to the high protection level (e.g., the electronic processor 205 increases the maximum current from 300 ma to 400 ma). On the other hand, when the electronic processor 205 determines that the number of increasing duty cycles remains below the first predetermined threshold, the electronic processor 205 proceeds to determine whether the number of decreasing duty cycles is greater (or equal to) a second predetermined threshold (step 1045).

In the illustrated embodiment, the second predetermined threshold is higher than the first predetermined threshold. For example, the second predetermined threshold corresponds to four, while the first predetermined threshold corresponds to two. In other embodiments, the second predetermined threshold may correspond to, for example, eight. The electronic processor 205 then determines how many times the updated duty cycle is lower than the old duty cycle (i.e., the duty cycle before the last operation of the burner 160). The electronic processor 205 then compares the number of times that the updated duty cycle decreased to the second predetermined threshold. In one embodiment, the electronic processor 205 determines whether there have been at least four decreasing duty cycles. In some embodiments, the electronic processor 205 analyzes, for example, the last four updates to the duty cycle and determines whether all four have decreased the duty cycle. In other words, in some embodiments, the electronic processor 205 determines whether the duty cycle has decreased four consecutive times. For example, when the second predetermined threshold corresponds to four, the electronic processor 205 may determine whether the last four updates increased the duty cycle.

When the electronic processor 205 determines that the number of decreasing duty cycles is greater (or equal to) the second predetermined threshold, the electronic processor 205 sets the protection parameter to the next lower protection level. For example, when the electronic processor 205 originally sets the protection parameter at the high protection level (to 400 mA at, for example, step 1015), the electronic processor 205 lowers the protection parameter to the medium protection level (e.g., 300 mA) after four decreasing duty cycles. In another embodiment, when the electronic processor 205 originally sets the protection parameter at the medium protection level (at 300 mA at, for example, step 1030), the electronic processor 205 lowers the protection parameter to the low protection level (e.g., 200 mA) after four decreasing duty cycles. The electronic processor 205 continues to update the duty cycle on each operation of the burner 160 (step 1005) and adjusts the protection parameters of the powered anode 180 accordingly.

In some embodiments, the electronic processor 205 may also determine the setpoint temperature (e.g., the desired water temperature) and the differential water temperature (e.g., the difference between the setpoint temperature and the stored water temperature) to help determine the protection level for the protection parameter. For example, the electronic processor 205 may set the first predetermined threshold, the second predetermined threshold, or both based on the temperature differential. In one example, the electronic processor 205 may set the second predetermined threshold to two when the temperature differential is greater than a high differential threshold (e.g., ten degrees). In the same example, the electronic processor 205 may set the second predetermined threshold to six when the temperature differential is lower than a low differential threshold (e.g., six degrees).

Although the steps for the flowcharts above have been described as being performed serially, in some embodiments, the steps may be performed in a different order and two or more steps may be carried out in parallel to, for example, expedite the control process. Additionally, the electronic processor 205 may combine steps from each of the methods described above. For example, methods 500 and 600 of FIGS. 5 and 6, respectively may be combined with methods 300 and 400 of FIGS. 3 and 4, respectively. Additionally, the electronic processor 205 may control the powered anode 180 based on both the duty cycle of the water heater 100 and whether the burner 160 is currently powered. Therefore, the electronic processor 205 can provide more adequate protection to all the surfaces of the water heater 100, including the surface of the flue 155.

Thus, the application provides, among other things, a system and method for controlling a powered anode. Various features and advantages of the application are set forth in the following claims.

The invention claimed is:

1. A gas-fired appliance comprising:
- a tank configured to store a fluid to be heated;
- a powered anode extending into the tank and configured to generate an electric anode current;
- a combustion chamber including a burner configured to burn a mixture of air and fuel to generate products of combustion;
- an exhaust structure coupled to the tank;
- a heat exchanger in fluid communication with the combustion chamber and the exhaust structure, wherein the products of combustion flow from the combustion chamber to the exhaust structure via the heat exchanger; and
- an electronic processor coupled to the powered anode, the electronic processor configured to:
  - determine a duty cycle of the burner,
  - determine whether the duty cycle of the burner exceeds a predetermined threshold,
  - increase a magnitude of a protection parameter of the powered anode from a first value to a second value when the duty cycle of the burner exceeds the predetermined threshold, and
  - control the powered anode according to the second value of the protection parameter.

2. The gas-fired appliance of claim 1, wherein the protection parameter includes one selected from a group consisting of a setpoint voltage of the powered anode, an applied voltage of the powered anode, an applied current of the powered anode, a minimum current threshold for the powered anode, and a maximum current threshold for the powered anode.

3. The gas-fired appliance of claim 1, wherein the electronic processor is further configured to measure a conductivity of the fluid stored in the tank, and set the protection parameter to the first value based on the conductivity of the fluid.

4. The gas-fired appliance of claim 3, wherein the electronic processor is further configured to measure a natural potential of the tank, and wherein the electronic processor sets the protection parameter to the first value based on the conductivity of the fluid and the natural potential of the tank.

5. The gas-fired appliance of claim 1, wherein the electronic processor is further configured to detect whether the burner is in operation, and wherein the electronic processor increases the magnitude of the protection parameter of the powered anode from the first value to the second value in response to the electronic processor detecting that the burner is in operation.

6. The gas-fired appliance of claim 5, wherein the electronic processor is configured to measure a conductivity of the fluid in the tank, and increase the magnitude of the protection parameter from the second value to a third value when the conductivity of the fluid is below a predetermined conductivity threshold.

7. The gas-fired appliance of claim 5, further comprising a temperature detector configured to measure a temperature of the fluid stored in a lower portion of the tank, and wherein the electronic processor is configured to:

receive a measured temperature from the temperature detector, determine whether the measured temperature is below a predetermined temperature while the burner is in operation, and increase the magnitude of the protection parameter from the second value to a third value when the measured temperature is below the predetermined temperature while the burner is in operation.

8. The gas-fired appliance of claim 1, wherein the electronic processor is configured to periodically update the duty cycle of the burner based on a predetermined update cycle.

9. The gas-fired appliance of claim 1, wherein the second value is approximately 30% than the first value.

10. The gas-fired appliance of claim 1, wherein the electronic processor increases the magnitude of the protection parameter based on a standby baseline current of the powered anode, wherein the standby baseline current is measured during a period of inactivity of the gas-fired appliance.

11. A method of operating a gas-fired appliance including a heat exchanger, the method comprising:

activating a burner within a combustion chamber of the gas-fired appliance to burn a mixture of air and fuel and generate products of combustion;

heating a fluid stored in a tank of the gas-fired appliance with the heat exchanger as the products of combustion flow from the combustion chamber to an exhaust structure of the gas-fired appliance;

generating an electric anode current with a powered anode extending into the tank of the gas-fired appliance;

determining, with an electronic processor of the gas-fired appliance, a duty cycle of the burner;

determining, with the electronic processor, whether the duty cycle exceeds a predetermined threshold;

increasing, with the electronic processor, a magnitude of a protection parameter of the powered anode from a first value to a second value when the duty cycle exceeds the predetermined threshold; and controlling, with the electronic processor, the powered anode according to the second value of the protection parameter.

12. The method of claim 11, further comprising:

determining, with the electronic processor, a conductivity of the fluid stored in the tank; and setting, with the electronic processor, the protection parameter of the powered anode at the first value based on the conductivity of the fluid stored in the tank.

13. The method of claim 12, further comprising:

determining, with the electronic processor, a natural potential of the tank, and wherein setting the protection parameter at the first value includes setting the protection parameter of the powered anode based on the conductivity of the fluid and the natural potential of the tank.

14. The method of claim 11, further comprising:

detecting, with the electronic processor, whether the burner is in operation;

increasing, with the electronic processor, the magnitude of the protection parameter of the powered anode from the first value to the second value in response to detecting that the burner is in operation.

15. The method of claim 14, further comprising:

determining, with the electronic processor, a conductivity of the fluid in the tank;

increasing, with the electronic processor, the magnitude of the protection parameter of the powered anode from the second value to a third value when the conductivity of the fluid is below a predetermined conductivity threshold; and controlling, with the electronic processor, the powered anode according to the third value of the protection parameter.

16. The method of claim 14, further comprising:

measuring, with a temperature detector in the tank, a temperature of the fluid in a lower portion of the tank;

receiving, with the electronic processor, the temperature of the fluid;

determining, with the electronic processor, whether the temperature of the fluid is below a predetermined temperature while the burner is in operation;

increasing, with the electronic processor, the magnitude of the protection parameter of the powered anode from the second value to a third value when the temperature of the fluid is below the predetermined temperature while the burner is in operation; and controlling, with the electronic processor, the powered anode according to the third value of the protection parameter.

17. The method of claim 11, wherein setting the magnitude of the protection parameter to the second value includes setting the magnitude of one selected from a group consisting of a setpoint voltage of the powered anode, an applied voltage of the powered anode, an applied current of the powered anode, a minimum current threshold for the powered anode, and a maximum current threshold for the powered anode.

18. The method of claim 11, wherein determining the duty cycle of the burner includes periodically updating the duty cycle of the burner based on a predetermined update cycle duration.

19. The method of claim 11, further comprising determining, with the electronic processor, a standby baseline current of the powered anode, the standby baseline current of the powered anode corresponding to a current of the powered anode that is measured during a period of inactivity of the gas-fired appliance, and wherein increasing the magnitude of the protection parameter from the first value to the second value includes increasing, with the electronic processor, the magnitude of the protection parameter from the first value to the second value based on the standby baseline current of the powered anode.

20. The method of claim 19, wherein determining the standby baseline current includes calculating, with the electronic processor, a rolling average of the standby baseline current each time the gas-fired appliance enters a new period of inactivity.

* * * * *